US006782723B2

(12) United States Patent
Chen

(10) Patent No.: US 6,782,723 B2
(45) Date of Patent: Aug. 31, 2004

(54) FLEXIBLE SHACKLE LOCK WITH A REPLACEABLE SHACKLE AND A REPLACEABLE LOCK CORE

(75) Inventor: Waterson Chen, 8F, No. 428, Wu-Chuan S. Rd., Taichung City (TW)

(73) Assignee: Waterson Chen, Taichung (TW)

( * ) Notice: Subject to any disclaimer, the term of this patent is extended or adjusted under 35 U.S.C. 154(b) by 110 days.

(21) Appl. No.: 10/126,095

(22) Filed: Apr. 19, 2002

(65) Prior Publication Data

US 2003/0196462 A1 Oct. 23, 2003

(51) Int. Cl.[7] ..... E05B 67/06

(52) U.S. Cl. ..... 70/49; 70/56; 70/53; 70/427

(58) Field of Search ..... 70/18, 30, 49, 70/53–56, 58, 416, 417, 423, 424, 427, 428, 455

(56) References Cited

U.S. PATENT DOCUMENTS

| | | | | | |
|---|---|---|---|---|---|
| 1,380,719 | A | * | 6/1921 | Johnson | 70/53 X |
| 1,384,561 | A | * | 7/1921 | Hampton | 70/53 X |
| 1,534,936 | A | * | 4/1925 | Fischbach | 70/49 |
| 1,539,301 | A | * | 5/1925 | Cooper | 70/53 X |
| 1,545,660 | A | * | 7/1925 | Johnson | 70/49 |
| 1,545,902 | A | * | 7/1925 | Johnson | 70/53 X |
| 1,566,965 | A | * | 12/1925 | Johnson | 70/49 |
| 1,681,409 | A | * | 8/1928 | Johnson | 70/53 X |
| 1,786,511 | A | * | 12/1930 | Warren | 70/53 X |
| 2,959,951 | A | * | 11/1960 | Mirkin | 70/39 |
| 3,605,458 | A | * | 9/1971 | Best | 70/49 |
| 3,696,647 | A | * | 10/1972 | Balicki | 70/49 |
| 3,714,804 | A | * | 2/1973 | French | 70/419 |
| 3,728,879 | A | * | 4/1973 | Best | 70/49 X |
| 3,933,015 | A | * | 1/1976 | Balicki | 70/49 |
| 3,981,168 | A | * | 9/1976 | Vanelli Coralli et al. | 70/417 |
| 4,075,878 | A | * | 2/1978 | Best | 70/49 |
| 4,157,602 | A | * | 6/1979 | Pennell | 70/18 X |
| 4,222,253 | A | * | 9/1980 | Peitsmeier | 70/368 X |
| 4,490,998 | A | * | 1/1985 | Wellekens | 70/427 X |
| 4,587,817 | A | * | 5/1986 | Self | 70/427 |
| 4,850,207 | A | * | 7/1989 | Ylven | 70/49 |
| 4,869,082 | A | * | 9/1989 | Appelbaum | 70/54 X |
| 5,406,810 | A | * | 4/1995 | Chen | 70/49 X |
| 5,447,043 | A | * | 9/1995 | Hwang | 70/49 |
| 5,896,762 | A | * | 4/1999 | Iidaka et al. | 70/53 X |
| 5,946,957 | A | * | 9/1999 | Yamamoto et al. | 70/423 |
| 5,979,200 | A | * | 11/1999 | Cliff | 70/368 X |
| 5,987,939 | A | * | 11/1999 | Pitisettakarn | 70/33 |
| 6,263,711 | B1 | * | 7/2001 | Kuo | 70/49 X |
| 6,305,198 | B1 | * | 10/2001 | Chastain et al. | 70/56 X |
| 6,393,876 | B1 | * | 5/2002 | Matyko | 70/56 X |
| 6,408,661 | B1 | * | 6/2002 | Chen | 70/33 |
| 6,467,316 | B1 | * | 10/2002 | Chen | 70/56 |
| 6,508,086 | B2 | * | 1/2003 | Chen | 70/49 |
| 6,550,298 | B1 | * | 4/2003 | Su | 70/455 X |
| 6,598,439 | B1 | * | 7/2003 | Chen | 70/423 |

* cited by examiner

*Primary Examiner*—Suzanne Dino Barrett
(74) *Attorney, Agent, or Firm*—Merchant & Gould P.C.

(57) ABSTRACT

A shackle lock includes a lock casing, a lock core received in the lock casing, and a shackle unit which has first and second shackle connecting members extendible into first and second shackle holes in the lock casing and a flexible shackle portion connected to the shackle connecting members at two opposite ends. The first shackle connecting member engages the lock core when the lock core is operated to be in a locking state, and is disengaged from the lock core when the lock core is operated to be in an unlocking state, thereby permitting removal thereof from the lock casing. The second shackle connecting member is provided with a spring-loaded retaining member for engaging the lock casing. The retaining member is accessible with the use of a tool inserted into the first shackle hole after removal of the first shackle connecting member, and is adapted to be actuated by the tool for disengaging from the lock casing in order to permit removal of the second shackle connecting member from the lock casing.

18 Claims, 23 Drawing Sheets

FLEXIBLE SHACKLE LOCK WITH A REPLACEABLE SHACKLE AND A REPLACEABLE LOCK CORE

BACKGROUND OF THE INVENTION

1. Field of the Invention

The present invention relates to a flexible shackle lock, more particularly to a flexible shackle lock with a shackle unit and a lock core which are detachable from a lock casing to permit replacement of the shackle unit and the lock core.

2. Description of the Related Art

A flexible shackle lock generally includes an elongated flexible shackle member which extends through an article to be locked. The flexible shackle lock is commonly used for locking an article with a complicated configuration or for locking together a series of articles. FIGS. 1 and 2 illustrate a conventional shackle lock of this type. The shackle lock includes a lock body 1 provided with a combination lock unit 3 therein and having two opposite ends formed respectively with first and second shackle holes 101, 102. A flexible elongated shackle member 7 has opposite ends connected respectively with first and second shackle connecting members 701, 702 which are rigid. The first shackle connecting member 701 is fixed to the lock body 1 at the first shackle hole 101. The second shackle connecting member 702 is extendible into the second shackle hole 102, and is formed with an annular groove 703 for engaging a latch member 6 of the combination lock unit 3 when the combination lock unit 3 is in a locking state. When the lock unit 3 is operated to be in an unlocking state, the latch member 6 is disengaged from the annular groove 703 to permit removal of the second shackle connecting member 702 from the lock body 1. Since the first shackle connecting member 701 is secured to the lock body 1, and since the length of the shackle member 7 is fixed, the shackle lock is useful within a limited range. It is desirable for the user that the shackle member 7 be replaceable with one having a different length. Moreover, replacement of the lock unit 3 is complicated and laborious.

SUMMARY OF THE INVENTION

Therefore, the main object of the present invention is to provide a flexible shackle lock with a shackle unit and a lock core which are detachable from a lock casing to permit replacement of the shackle unit and the lock core.

Accordingly, the shackle lock of the present invention comprises: a seamless lock casing having a lock core chamber, a lock core opening for access to the lock core chamber and aligned with the lock core chamber in a first direction, a first shackle chamber, a first shackle hole for access to the first shackle chamber and aligned with the first shackle chamber in a second direction parallel to the first direction, a second shackle chamber, a second shackle hole for access to the second shackle chamber and aligned with the second shackle chamber in a third direction transverse to the second direction, a first channel confined by a first channel-confining wall and extending in a fourth direction transverse to the first and third directions for communicating the lock core chamber and the first shackle chamber, and a second channel confined by a second channel-confining wall and extending in the second direction for communicating the first shackle chamber and the second shackle chamber; a lock core received in the lock core chamber via the lock core opening and having a latch member and a keypassage that is exposed from the lock core opening and that is adapted to receive a key for moving the latch member between a locking position in which the latch member extends through the first channel and projects into the first shackle chamber, and an unlocking position, in which the latch member is moved out of the first shackle chamber; and a shackle unit including first and second shackle connecting members and a flexible elongated shackle portion with two opposite ends connected respectively to the first and second shackle connecting members. The first shackle connecting member is extendible into the first shackle chamber via the first shackle hole and is formed with a locking groove for engaging the latch member when the latch member is moved to the locking position. The second shackle connecting member is extendible into the second shackle chamber via the second shackle hole and is provided with a retaining member that extends into the second channel and that engages the second channel-confining wall upon movement of the second shackle connecting member in the third direction so as to retain the second shackle connecting member in the lock casing. The locking groove in the first shackle connecting member is disengaged from the latch member when the latch member is moved to the unlocking position, thereby permitting removal of the first shackle connecting member from the lock casing via the first shackle hole. The retaining member on the second shackle connecting member is accessible by means of a tool which is inserted into the second channel via the first shackle chamber and the first shackle hole when the first shackle connecting member is removed from the first shackle hole and is adapted to be actuated by the tool for disengaging from the second channel-confining wall in order to be removed from the lock casing via the second shackle hole.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENT

Figure 1:
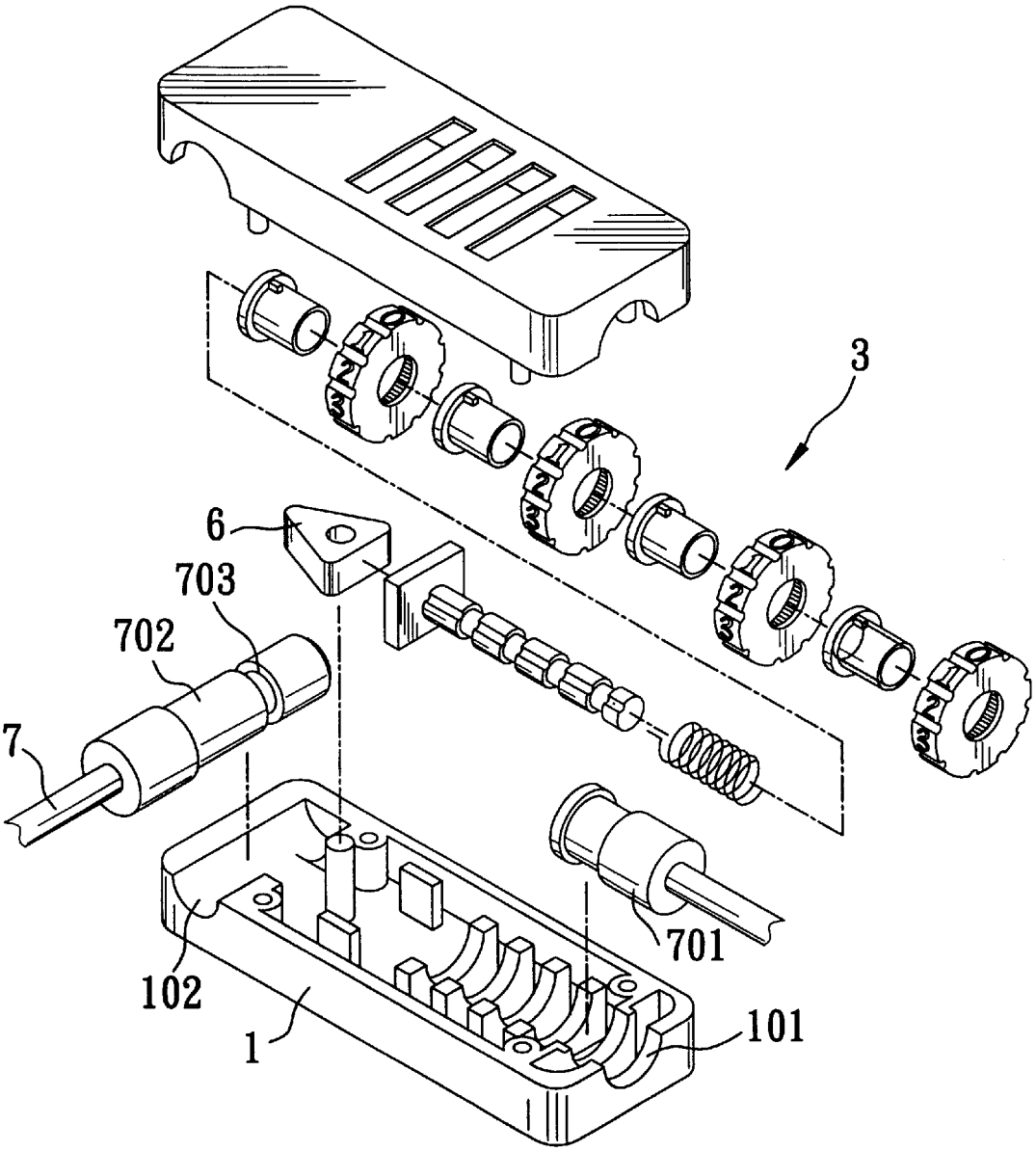
FIG. 1 PRIOR ART
FIG. 1 is a fragmentary exploded perspective view of a conventional shackle lock with a flexible elongated shackle member.
Figure 2:
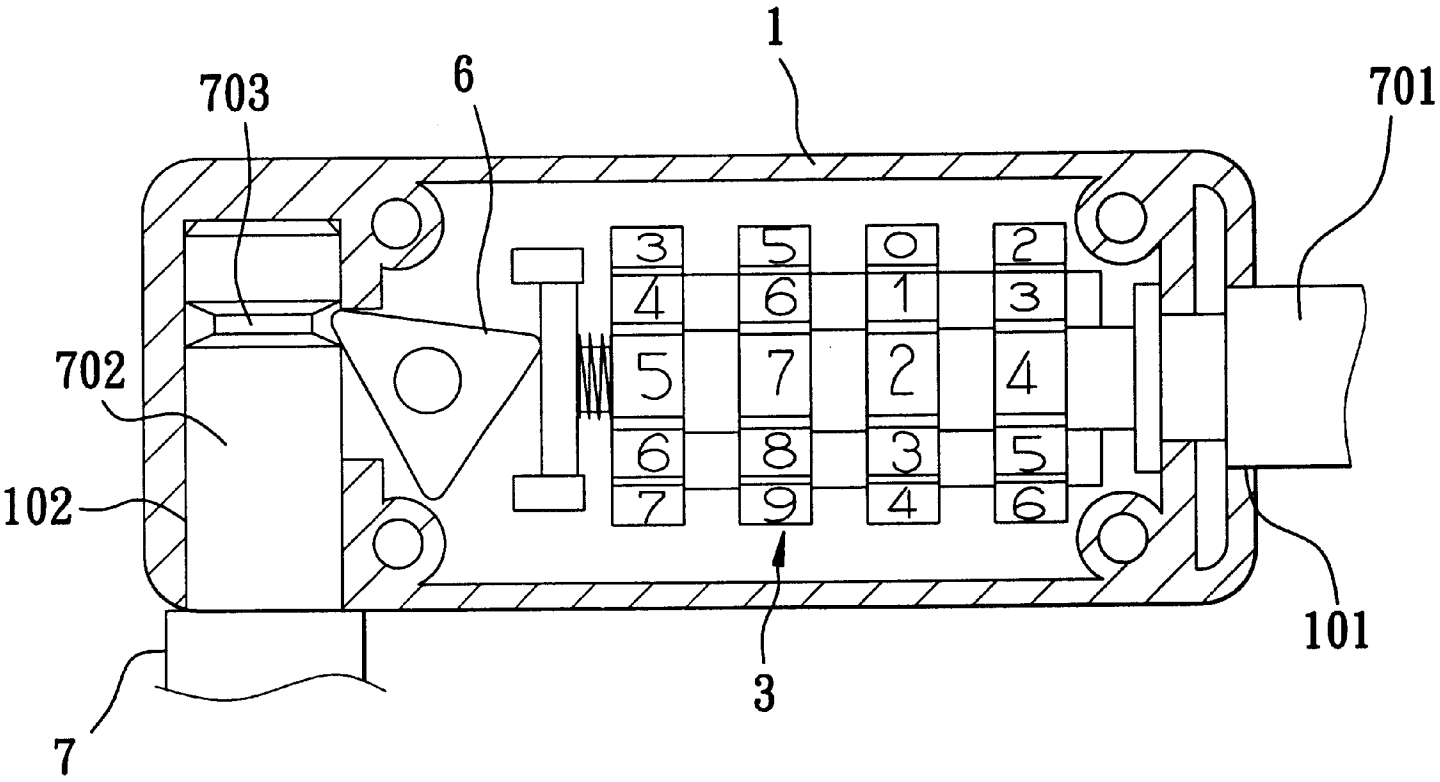
FIG. 2 PRIOR ART
FIG. 2 is a fragmentary sectional view of the conventional shackle lock.

Referring to FIGS. 3 to 6, the preferred embodiment of the shackle lock of the present invention is shown to include: a seamless lock casing 10 having a lock core chamber 11, a lock core opening 12 for access to the lock core chamber 11 and aligned with the lock core chamber 11 in a first direction, a first shackle chamber 14, a first shackle hole 142 for access to the first shackle chamber 14 and aligned with the first shackle chamber 14 in a second direction parallel to the first direction, a second shackle chamber 15, a second shackle hole 152 for access to the second shackle chamber 15 and aligned with the second shackle chamber 15 in a third direction transverse to the second direction, a first channel 141 confined by a first channel-confining wall 143 and extending in a fourth direction transverse to the first and second directions for communicating the lock core chamber 11 and the first shackle chamber 14, and a second channel 151 confined by a second channel-confining wall 153 and extending in the second direction for communicating the first shackle chamber 14 and the second shackle chamber 15; a lock core 20 received in the lock core chamber 11 via the lock core opening 12 and having a latch member 21 and a keypassage 23 that is exposed from the lock core opening 12 and that serves for receiving a key (not shown) for moving the latch member 21 between a locking position (see FIGS. 5 and 7), in which, the latch member 21 extends through the first channel 141 and projects into the first shackle chamber 14, and an unlocking position (see FIG. 8), in which the latch member 21 is moved out of the first shackle chamber 14; and a shackle unit 30 including first and second shackle connecting members 31, 32 and a flexible elongated shackle portion 37 with two opposite ends connected respectively to the first and second shackle connecting members 31, 32. The first shackle connecting member 31 is extendible into the first shackle chamber 14 via the first shackle hole 142 and is formed with a locking groove 311 for engaging the latch member 21 when the latch member 21 is moved to the locking position. The second shackle connecting member 32 is extendible into the second shackle chamber 15 via the second shackle hole 152 and is provided with a retaining member 33 that extends into the second channel 151 and that engages the second channel-confining wall 153 upon movement of the second shackle connecting member 32 in the third direction so as to retain the second shackle connecting member 32 in the lock casing 10. The locking groove 311 in the first shackle connecting member 31 is disengaged from the latch member 21 when the latch member 21 is moved to the unlocking position, thereby permitting removal of the first shackle connecting member 31 from the lock casing 10 via the first shackle hole 142 (see FIG. 9). The retaining member 33 on the second shackle connecting member 32 is accessible by means of a tool 100 (see FIG. 10) which is inserted into the second channel 153 via the first shackle chamber 14 and the first shackle hole 142 when the first shackle connecting member 31 is removed from the first shackle hole 142, and can be thus actuated by the tool 100 for disengaging from the second channel-confining wall 153 in order to be removed from the lock casing 10 via the second shackle hole 152. The lock casing 10 includes an open box 16 and a top cover 17 that covers and that is welded to a top open end of the open box 16 in such a manner that the lock casing is seamless.

The second shackle connecting member 32 of the shackle unit 30 is formed with a slot 321 that communicates with the second channel 151. The retaining member 33 includes a retaining block 332 mounted slidably in the slot 321, and a biasing spring 333 received in the slot 321 for biasing the retaining block 332 to extend out of the slot 321 and into the second channel 151 so as to prevent removal of the second shackle connecting member 32 from the lock casing 10 via the second shackle hole 152. The retaining block 331 can be depressed by the tool 100 in the second direction for retracting into the slot 321 so as to permit removal of the second shackle connecting member 32 from the lock casing 10 via the second shackle hole 152.

The latch member 21 engages the first channel-confining wall 143 upon movement of the lock core 20 in the first direction when the latch member 21 is positioned at the unlocking position so as to prevent removal of the lock core 20 from the lock casing 10 via the lock core opening 12. The latch member 21 is accessible by the tool 100 which is inserted into the first channel 141 via the first shackle chamber 14 and the first shackle hole 142 when the first shackle connecting member 31 is removed from the first shackle hole 142, and can be thus actuated by the tool 100 for disengaging from the first channel-confining wall 141 in order to be removed from the lock casing 10 via the lock core opening 12.

The latch member 21 includes a latch base 24 which projects from the lock core 20 in the lock core chamber 11 in the first direction, which is rotatable relative to a housing of the lock core 20 when the lock core 20 is operated via the key (not shown), and which is formed with a cavity 240. The latch member 21 further includes a latch body 25 mounted on the latch base 24 and extending into the cavity 240, and a biasing spring 26 received in the cavity 240 for biasing the latch body 25 to extend out of the cavity 240 and to project from the latch base 24 through the first channel 141 and into the first shackle chamber 14 when the latch member 21 is positioned at the locking position. The latch body 25 can be depressed in the fourth direction by the tool 100 against biasing action of the biasing spring 26 for retracting into the cavity 240 to permit removal of the lock core 20 from the lock casing 10.

The first shackle connecting member 31 of the shackle unit 30 is formed with a stud 312 that extends into the second channel 151 when the first shackle connecting member 31 extends into the first shackle chamber 14. The retaining block 332 of the retaining member 33 is formed with a recess 331 for receiving the stud 312 when the first and second shackle connecting members 31, 32 are inserted into the first and second shackle chambers 14, 15, respectively, so as to enhance positioning of the first and second shackle chambers 14, 15 in the lock casing 10.

A resilient lock protective sleeve 40 includes a sleeve body 46 sleeved on the lock casing 10. The sleeve body 46 has an open end 42 that permits insertion of the lock casing 10 thereinto, and two access openings 45 aligned respectively with the first and second shackle holes 142, 152 in the lock casing 10 to permit extension of the first and second shackle connecting members 31, 32 of the shackle unit 30 therethrough. A cover flap 43 is hinged to the sleeve body 46 at the open end 42. The cover flap 43 is pivotable toward the lock core opening 12 in the lock casing 10 for covering the same, and away from the lock core opening 12 to permit access to lock core 20 via the lock core opening 12. The cover flap 43 is formed with a plug 44 which is inserted into the keypassage 23 when the cover flap 43 covers the lock core opening 12.

Figure 3:
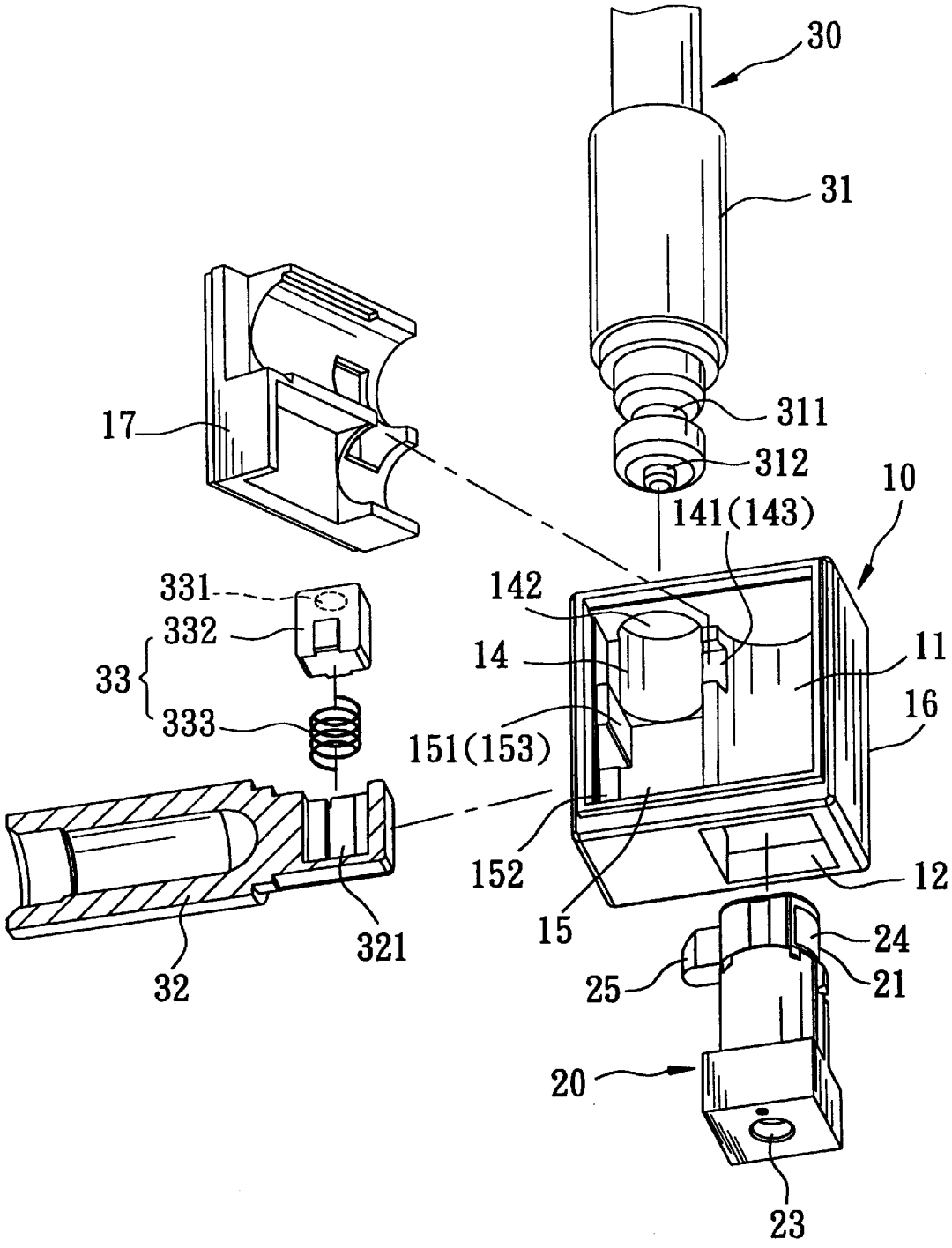
FIG. 3 is a partly sectioned, exploded perspective view of a preferred embodiment of a shackle lock of the present invention, where a lock protective sleeve for protecting a lock casing is omitted for the sake of clarity.
Figure 4:
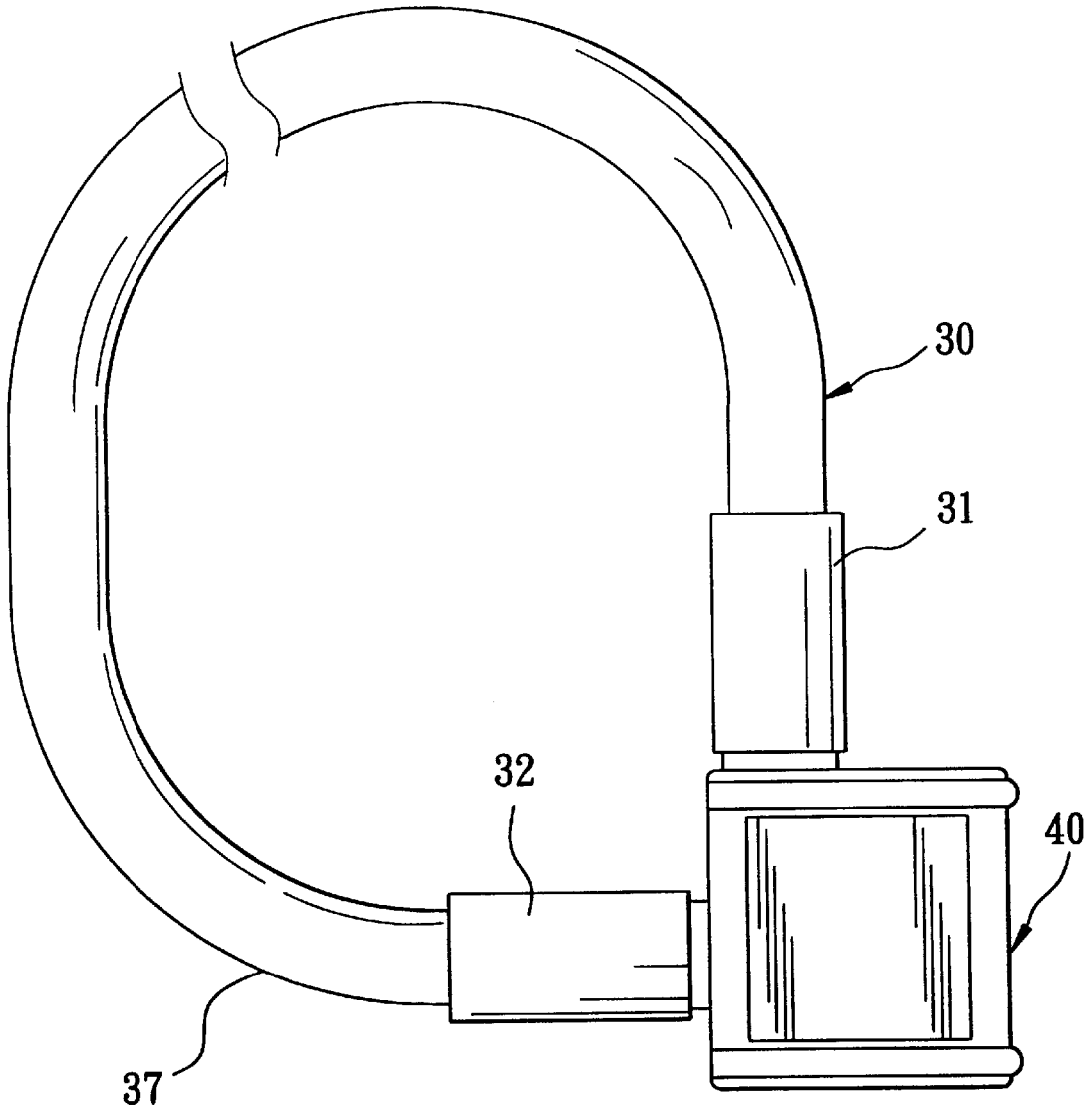
FIG. 4 is a plan view of the preferred embodiment.
Figure 5:
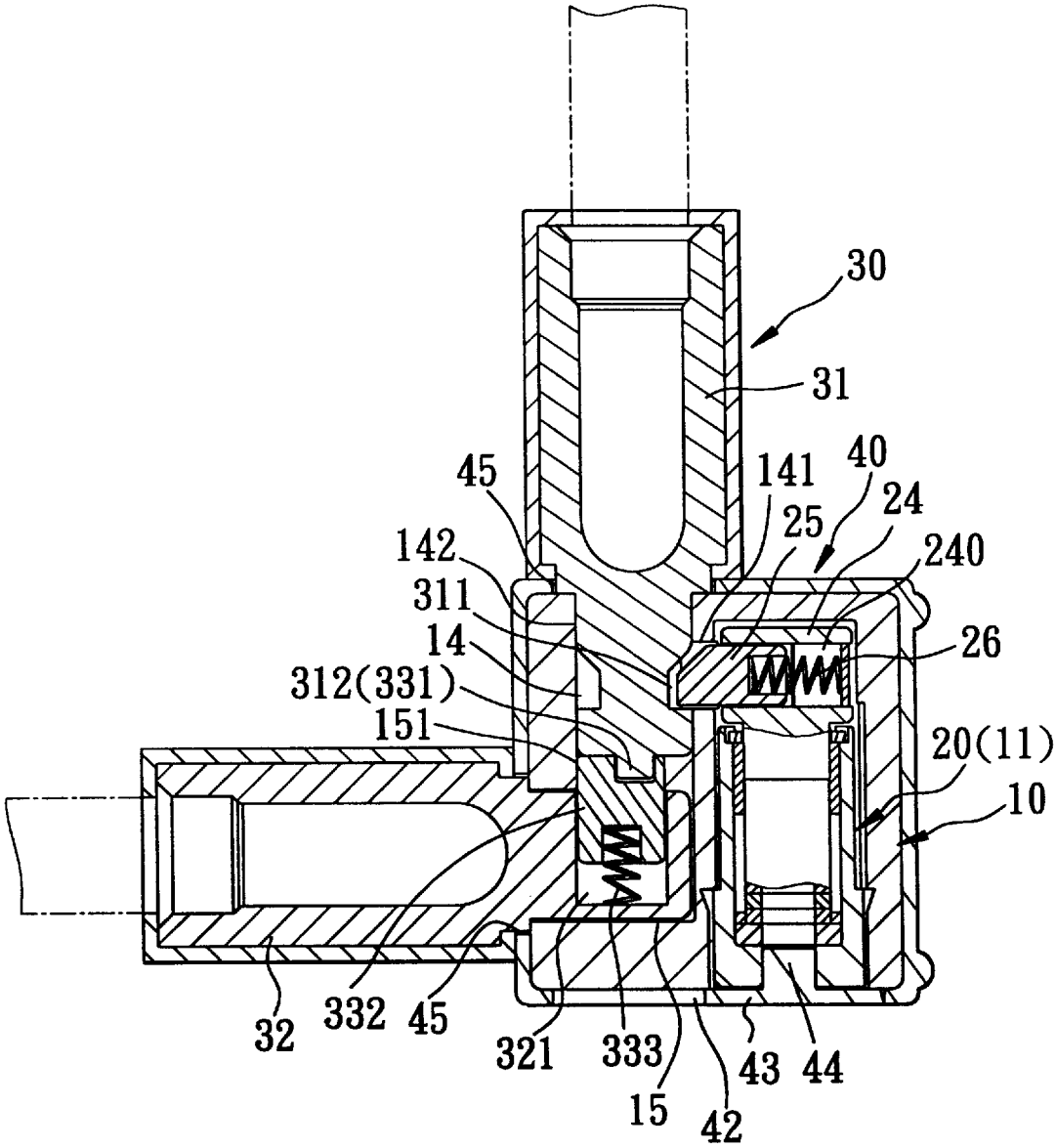
FIG. 5 is a fragmentary sectional view of the preferred embodiment in a locking state.
Figure 6:
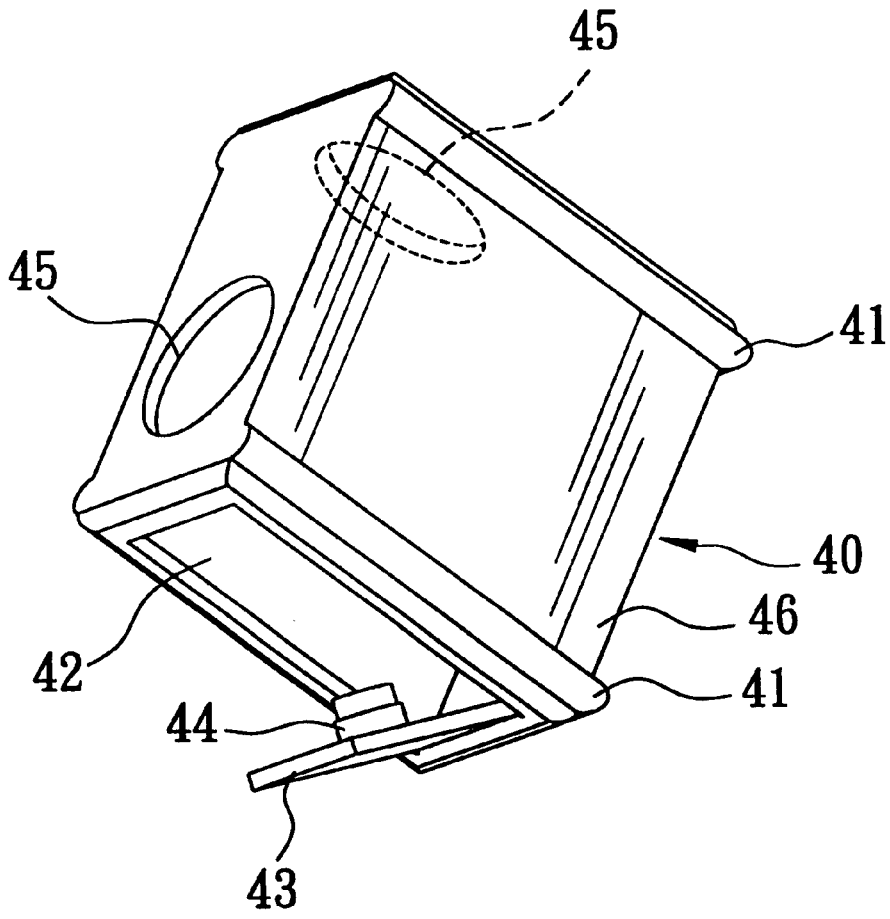
FIG. 6 is a perspective view of the lock protective sleeve.
Figure 7:
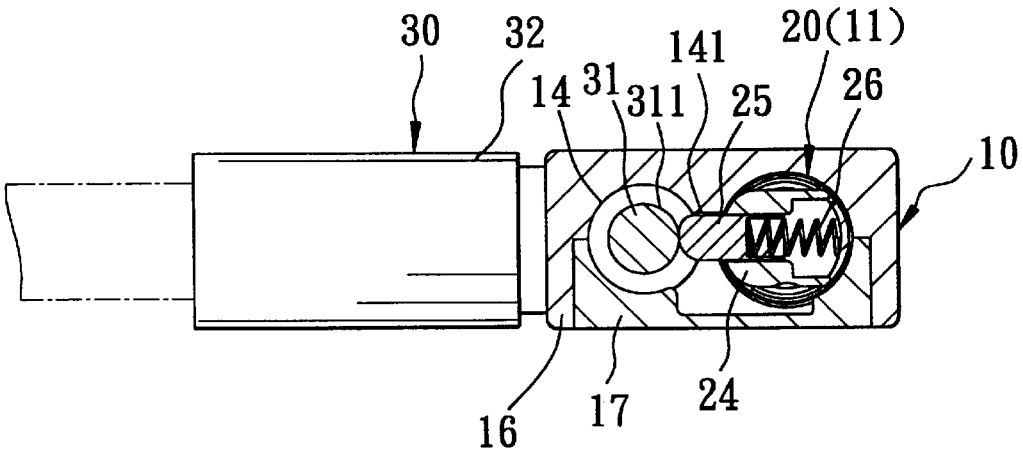
FIG. 7 is fragmentary sectional view of the preferred embodiment with the lock core illustrated in the locking state, and with a lock protective sleeve and a shackle protective sleeve removed for the sake of clarity.

Referring to FIGS. 3, 5 and 7, in use, the second shackle connecting member 32 is inserted into the second shackle hole 152 for engaging the lock casing 10. After extending through an article (not shown) to be locked, the first shackle connecting member 31 is inserted into the first shackle hole 142, thereby enabling the latch body 25 on the lock core 20 to extend into the locking groove 311 for engaging the first shackle connecting member 31.

Figure 8:
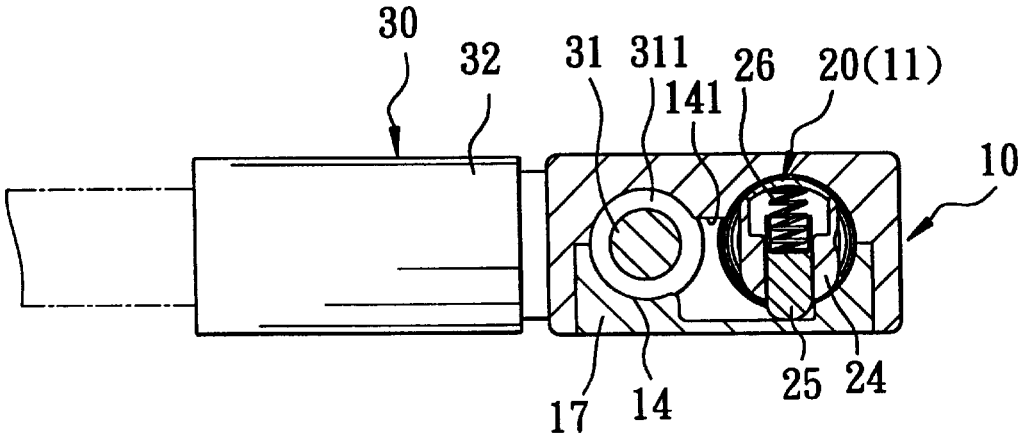
FIG. 8 is a fragmentary sectional view of the preferred embodiment similar to FIG. 7, but with the lock core illustrated in the unlocking state.
Figure 9:
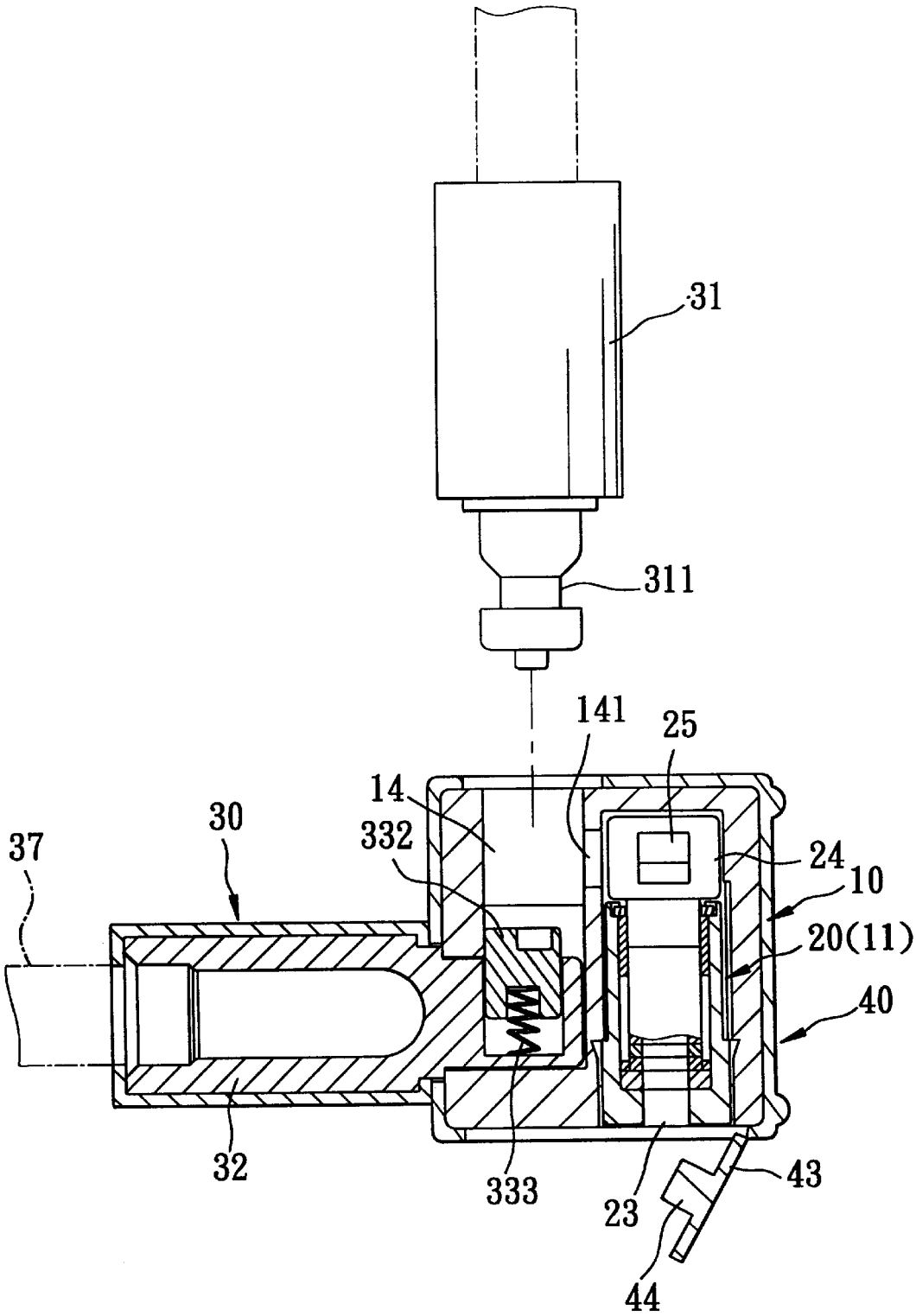
FIG. 9 is a fragmentary sectional view of the preferred embodiment, with a first shackle connecting member removed from a lock casing of the shackle lock.

Referring to FIGS. 8 and 9, to unlock the shackle lock, the corresponding key (not shown) is inserted into the keypassage 23 and is operated to turn the latch body 25 with the latch base 24 for moving the latch body 25 into the lock core chamber 11 so as to disengage the locking groove 311. The first shackle connecting member 31 is thus removable from the lock casing 10 via the first shackle hole 142.

Figure 10:
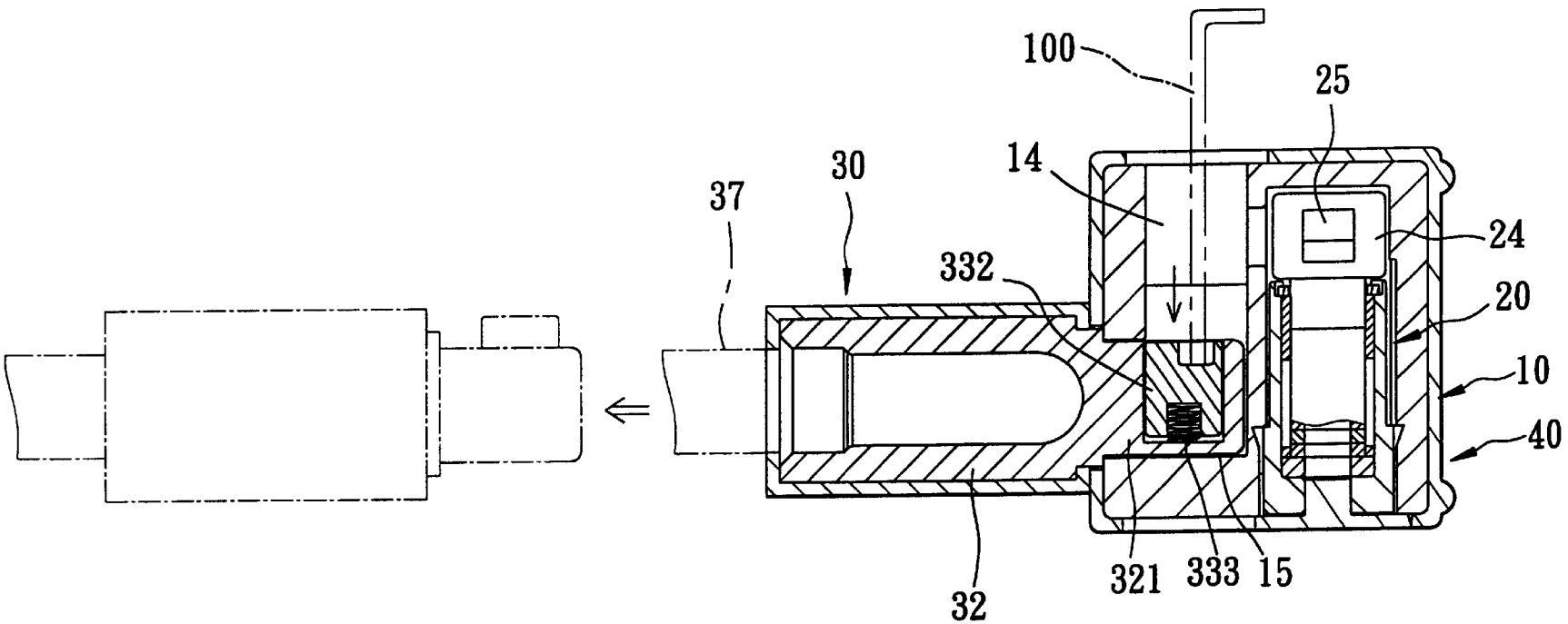
FIG. 10 is a fragmentary sectional view of the preferred embodiment, illustrating how a second shackle connecting member is removed from the lock casing.

Referring to FIGS. 9 and 10, in case the length of the flexible shackle portion 37 is not sufficient to extend through the article so as to lock the article, the shackle unit 30 can be replaced with one having a longer length, without the need for replacing the entire shackle lock. Replacement of the shackle unit 30 is conducted as follows: The lock core 20 is operated to rotate the latch member 24 to the unlocking position, and the first shackle connecting member 31 is removed from the first shackle hole 142. The tool 100 is inserted into the first shackle hole 142 to depress the retaining block 332 for retracting the retaining block 332 into the slot 321 in the second shackle connecting member 32. The retaining block 332 is thus disengaged from the lock casing 10 to permit removal of the second shackle connecting member 32 from the second shackle hole 152, thereby permitting separation of the entire shackle unit 30 from the lock casing 10. Thereafter, the second shackle connecting member of another shackle unit with a longer shackle portion is inserted into the second shackle hole 152 for engaging the lock casing 10, thus completing the replacement operation.

Figure 11:
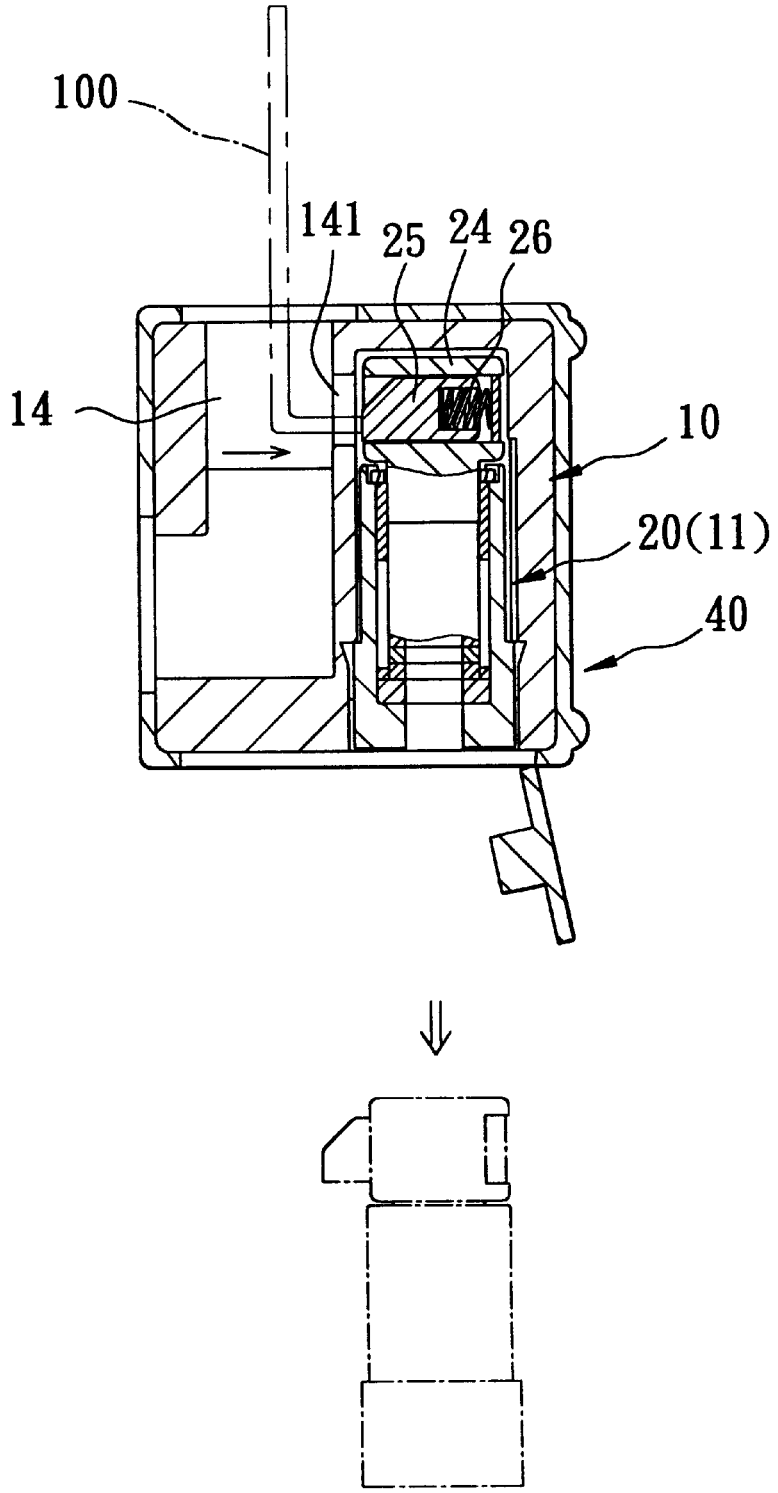
FIG. 11 is a fragmentary sectional view of the preferred embodiment, illustrating how a lock core is removed from the lock casing.

Referring to FIGS. 9 and 11, when the lock core 20 is damaged or disabled, such as due to corrosion, the lock core 20 can be replaced in the following manner: The lock core 20 is operated to move the latch member 24 to the unlocking position, and the first shackle connecting member 31 is removed from the first shackle hole 142. The tool 100 is inserted into the first shackle hole 142 to depress the latch body 25 for retracting the latch body 25 into the cavity 240 in the latch base 24 of the latch member 21. The latch member 21 is thus disengaged from the lock casing 10 to permit removal of the lock core 20 from the lock casing 10 via the lock core opening 12. After removal of the lock core 20, a new lock core is inserted into the lock core chamber 11 via the lock core opening 12 to permit the latch member on the new lock core to extend into the first channel 141 for engaging the lock casing 10, thus completing the replacement operation.

It has been shown that the lock casing 10 can be assembled selectively with shackle units 30 of different lengths, depending on the size and shape of the article to be locked. The replacement operation can be conducted easily and quickly by the user. Moreover, when the lock core 20 is damaged, the lock core 20 can be replaced without the need to replace the entire shackle lock.

Figure 12:
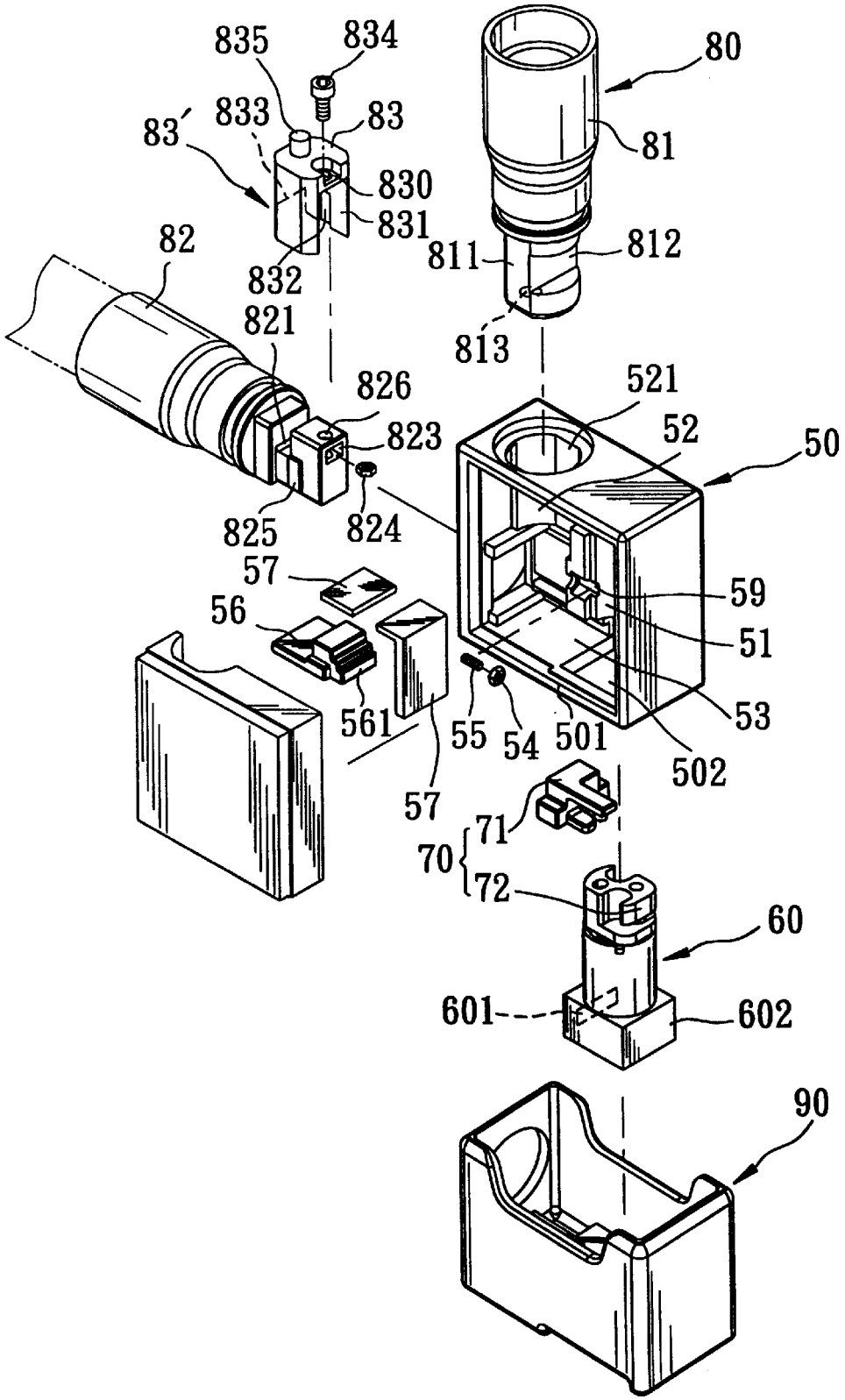
FIG. 12 is a partly sectioned, exploded perspective view of a second preferred embodiment of the shackle lock of the present invention.
Figure 13:
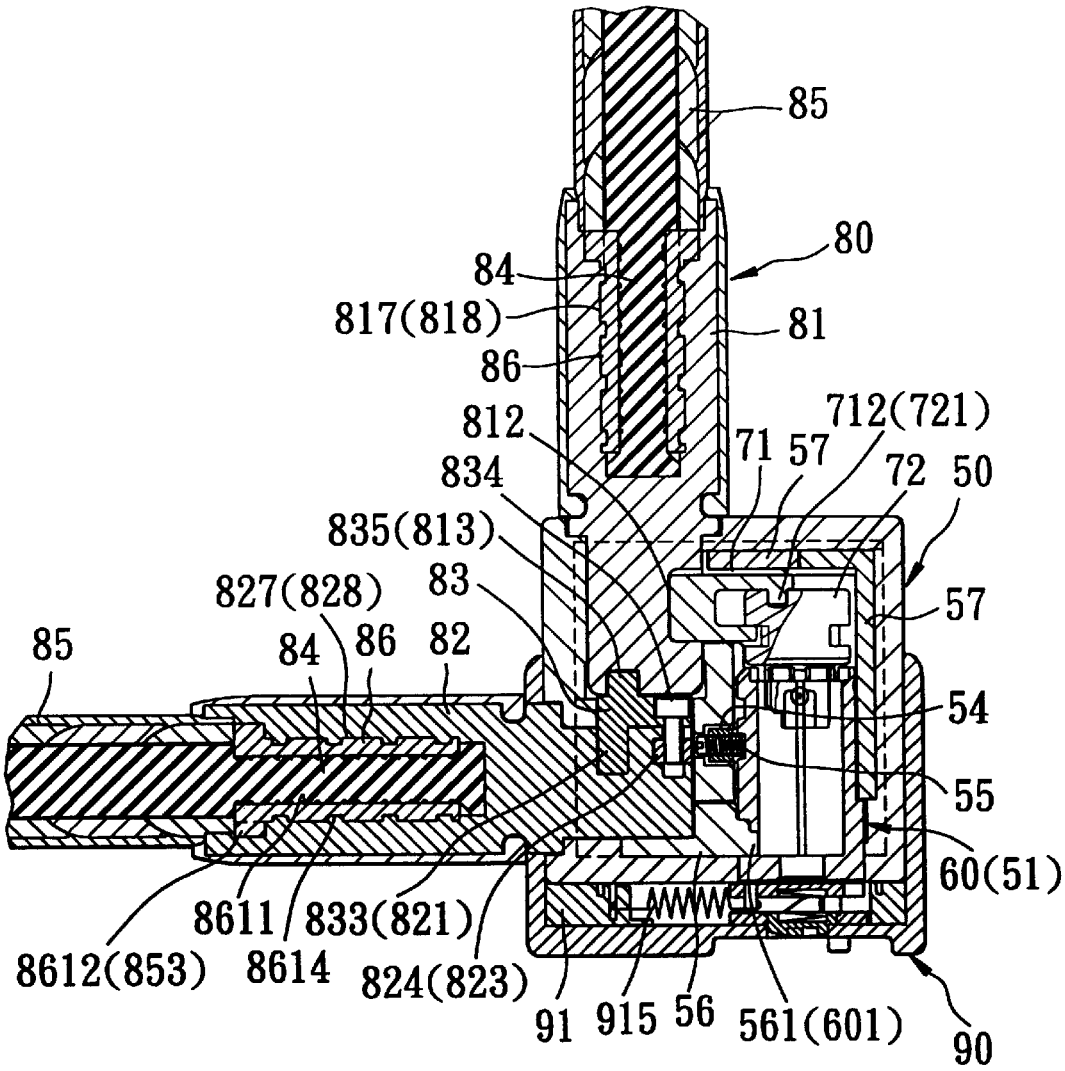
FIG. 13 is a is a fragmentary sectional view of the second preferred embodiment in a locking state.
Figure 14:
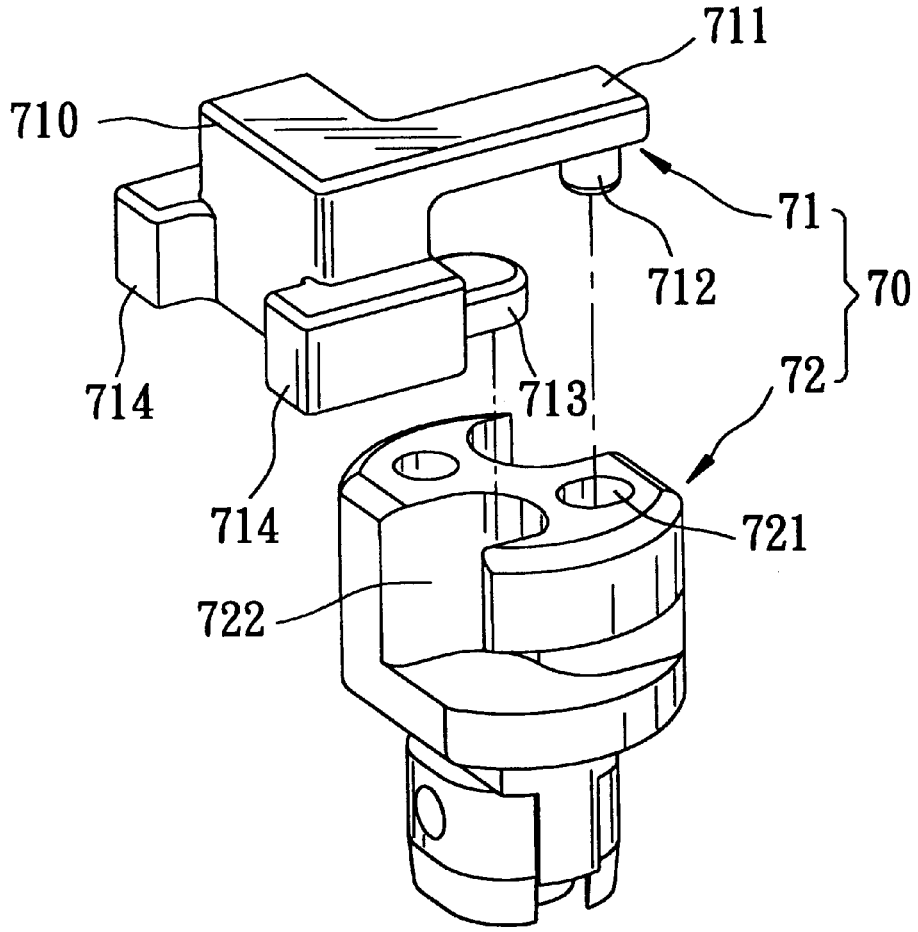
FIG. 14 is an exploded perspective view of a latch member of the lock core of the second preferred embodiment.

FIGS. 12 to 14 illustrate a second preferred embodiment of the shackle lock of this invention that is similar to the previous embodiment. The major difference between the two embodiments resides in that the second embodiment includes a latch member 70 and a retaining member 83 which are operated without using urging members (26, 333). It is noted that different reference numbers for the elements of the second embodiment which respectively correspond to those of the previous embodiment are used. Details of the second embodiment of the shackle lock are illustrated as follows.

Figure 15:
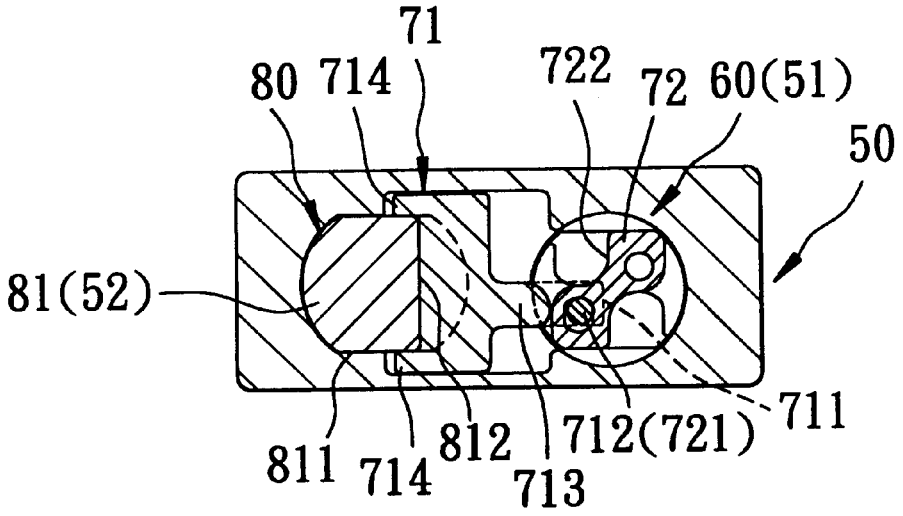
FIG. 15 is a fragmentary sectional view of the second preferred embodiment with the lock core illustrated in the locking state.
Figure 16:
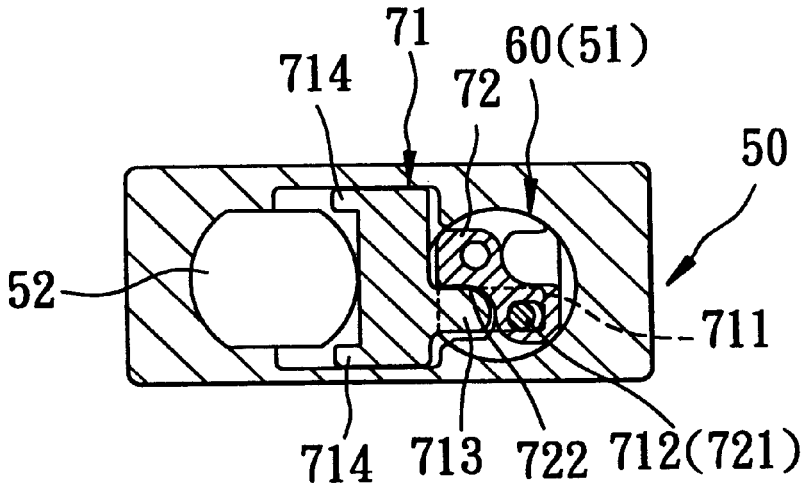
FIG. 16 is a fragmentary sectional view of the second preferred embodiment similar to FIG. 15, but with the lock core illustrated in the unlocking state.

The latch member 70 includes a latch base 72 which projects from the lock core 60 in the lock core chamber 51 in the first direction, which is rotatable when the lock core 60 is operated via the key (not shown), and which is formed with a retaining hole 721 extending in the first direction. The latch member 70 further includes a latch body 71 which has an engaging end 710 extendible into the locking groove 812 in the first shackle connecting member 81, a linking arm 711 projecting from the engaging end 710 in the fourth direction to the retaining hole 721, and an engaging tongue 712 projecting from the linking arm 711 into the retaining hole 721 so that rotation of the latch base 72 results in movement of the latch body 71 in the fourth direction toward and away from the locking groove 812 (see FIGS. 15 and 16), thereby permitting engagement and disengagement between the engaging end 710 and the locking groove 812.

The latch base 72 has a curved stopping wall 722 that extends curvedly from a periphery of the retaining hole 721.

The latch body 71 further includes a stopping arm 713 that projects from the engaging end 710 toward the stopping wall 722 in such a manner that the stopping arm 713 releasably engages the stopping wall 722 when the latch member 70 is moved from the locking position (see FIG. 15) to the unlocking position (see FIG. 16) so as to prevent further rotation of the latch base 72 and that the stopping wall 722 moves away from the engaging arm 713 when the latch member 70 is moved from the unlocking position to the locking position.

The first shackle connecting member 81 has two opposite flat faces 811. The locking groove 812 extends between the flat faces 811. The latch body 71 further includes two opposite guide wings 714 that project from the engaging end 710 of the latch body 71 and that are in sliding contact with the flat faces 811, respectively, so as to guide the movement of the latch body 71 in the fourth direction. The first shackle hole 521 in the lock casing 50 has two opposite chordal sections that conform to the flat faces 811 which serve as directional marks for directing the insertion of the first shackle connecting member 81 into the first shackle chamber 52.

Figure 17:
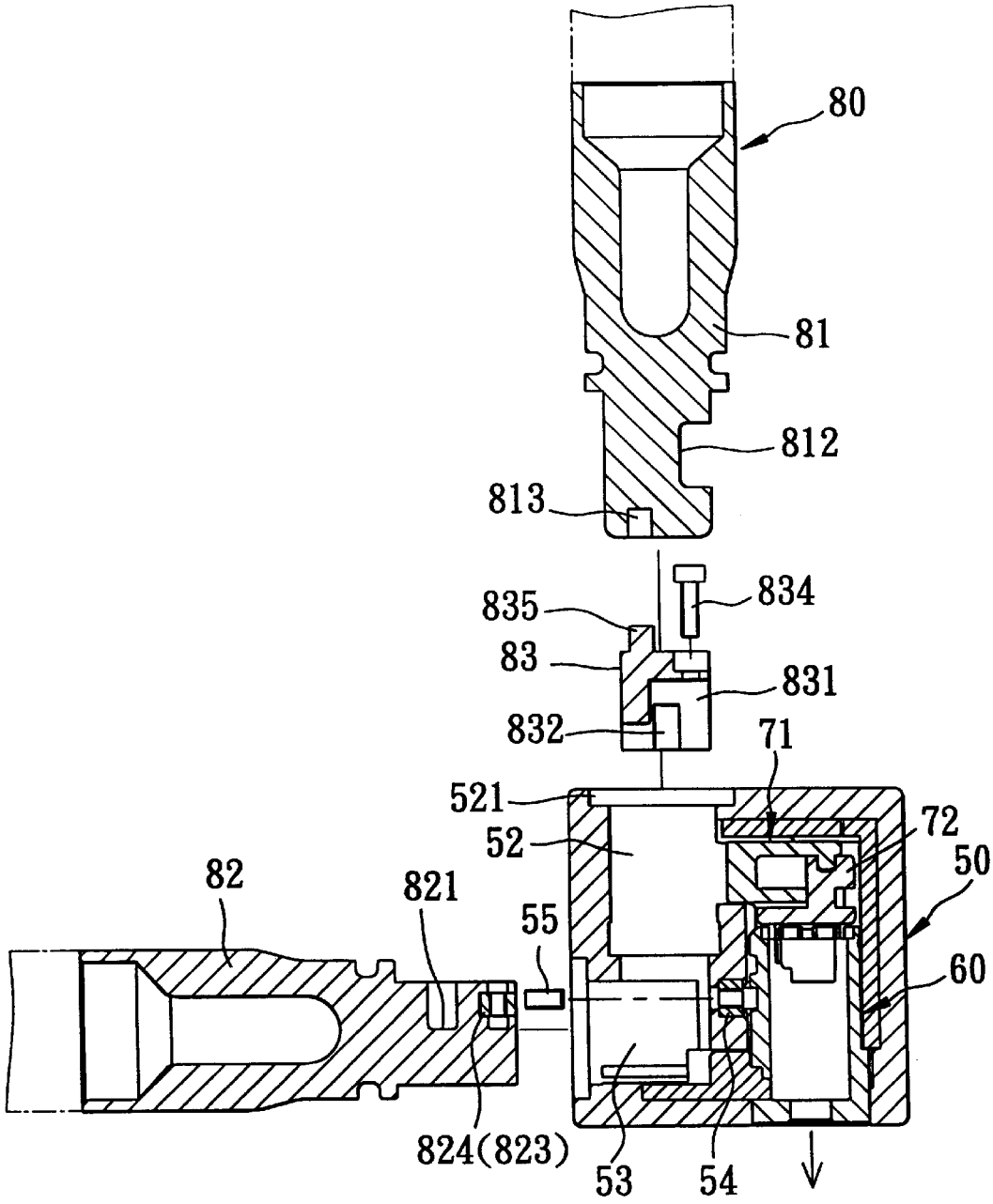
FIG. 17 is a fragmentary sectional view of the second preferred embodiment, illustrating how the first and second shackle connecting members and the lock core is removed from the lock casing.

The second shackle connecting member 82 is formed with a shackle cavity 823 and a first screw hole 826 in communication with the shackle cavity 823. The retaining member 83' includes a retaining body 83 formed with a second screw hole 830. A screw nut 824 is fixed in the shackle cavity 823. A screw bolt 834 extends through the first and second screw holes 826, 830, and threadedly engages the screw nut 824 so as to secure the retaining member 83' to the second shackle connecting member 82. The screw bolt 834 is accessible via the first shackle chamber 52 and the first shackle hole 521 when the first shackle connecting member 81 is removed from the locking case 50, thereby permitting disengagement of the retaining member 83' from the second shackle connecting member 82 and removal of the second shackle connecting member 82 from the locking case 50 (see FIG. 17).

The second shackle connecting member 82 is further formed with a first notch 821 adjacent to the shackle cavity 823 and extending in the second direction. The retaining body 83 is further formed with a second notch 833 that meshes with the first notch 821 when the retaining member 83' is secured to the second shackle connecting member 82.

The second shackle connecting member is further formed with two opposite guides 825 extending in the second direction. The retaining body 83 has two opposite legs 831 extending from a periphery of the second screw hole 830 in the second direction and formed with guiding grooves 832 that slidably engage the guides 825, respectively, for guiding movement of the retaining member 83' in the second direction.

The retaining member 83' further includes a stud 835 that projects from the retaining body 83 in the second direction. The first shackle connecting member 81 is formed with a recess 813 for receiving the stud 835 when the first and second shackle connecting members 81, 82 are inserted into the first and second shackle chambers 52, 53, respectively, so as to enhance positioning of the first and second shackle chambers 52, 53 in the lock casing 50.

The locking case 50 further has a third channel 59 extending in a fifth direction parallel to the fourth direction and communicating the lock core chamber 51 and the second shackle chamber 53. A screw nut 54 is fixed in the third channel 59. A screw rod 55 threadedly engages and extending through the screw nut so as to cooperate with the locking casing 50 to clamp the lock core 60, thereby preventing removal of the lock core 60 from the locking case 50.

The lock casing 50 has a front wall 501 that is formed with the lock core opening 502. The lock core 60 has a front end 602 formed with a retaining slot 601 adjacent to the lock core opening 502. A protecting plate 56 confronts and adjoins the front wall 501 within the locking case 50, and has an insertion portion 561 received fittingly in the retaining slot 601. The protecting plate 56 has a hardness that is greater than that of the front wall 501 so as to protect the lock core 60 from sabotage. A two-piece protecting plate 57 confronts and adjoins a rear wall and a side wall of the lock casing 50, and is made of a material the same as the protecting plate 56 so as to enhance the protection of the lock core 60 from sabotage.

Figure 18:
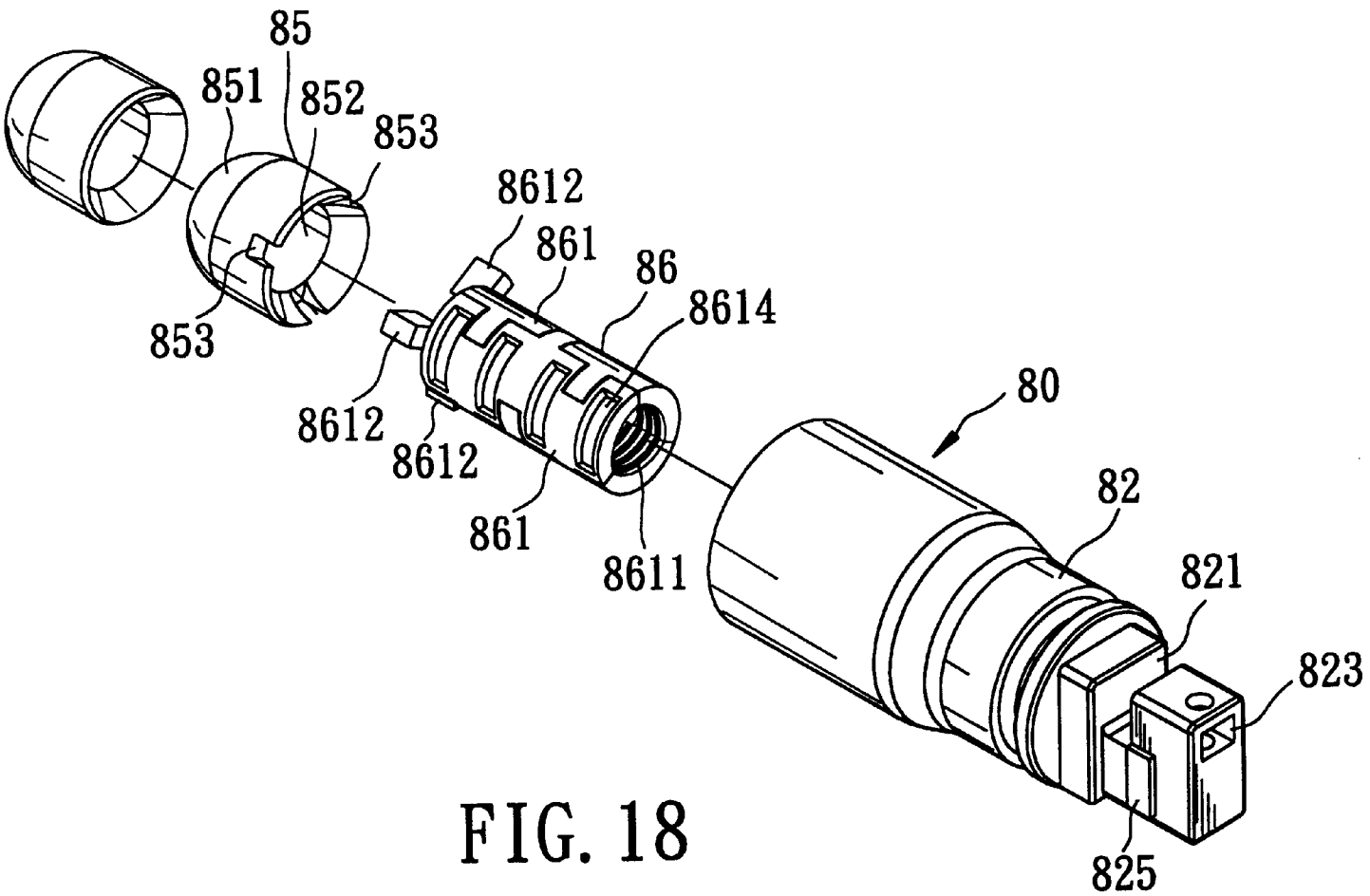
FIG. 18 is a fragmentary exploded perspective view of a shackle unit of the second preferred embodiment, where a rope member for connecting the first and second connecting members is omitted for the sake of clarity.

With reference to FIG. 18, in combination with FIG. 13, each of the first and second shackle connecting members 81, 82 is formed with an insertion hole 817 (827) which is confined by a hole-confining wall 818 (828) and which receives a respective one of the opposite ends of the elongated shackle portion 84. The shackle unit 80 further includes two tubular members 86 (only one is shown) disposed in the insertion holes 817, 827 in the first and second shackle connecting members 81, 82 and sleeved on the opposite ends of the elongated shackle portion 84, respectively. Each of the tubular member 86 includes a plurality of grooved arcuate parts 861 which are connected in such a manner that two of adjacent ones of the arcuate parts 861 are wedged to each other so as to form a plurality of inner and outer arcuate grooves 8611, 8614 in the tubular member 86 and so as to permit engagement among the tubular members 86, the opposite ends of the elongated shackle portion 84, and the hole-confining walls 818, 828 of the first and second shackle connecting members 81, 82 when the tubular members 86, the opposite ends of the elongated shackle portion 84, and the hole-confining walls 818, 828 of the first and second shackle connecting members 81, 82 are compressed and are deformed. During the aforesaid compression, portions of the shackle portion 84 and portions of the hole-confining wall 818 (828) are respectively deformed to extend into the inner and outer grooves 8611, 8614 so as to secure the opposite ends of the shackle portion 84 to the first and second shackle connecting members 81, 82 via the tubular members 86. Three spaced apart wedging plates 8612 project from one end of each of the tubular members 86. The tubular members 86 are made from a metal alloy, and have a hardness that is greater than that of the first and second shackle connecting members 81, 82 so as to protect the first and second shackle connecting members 81, 82 from sabotage.

Figure 19:
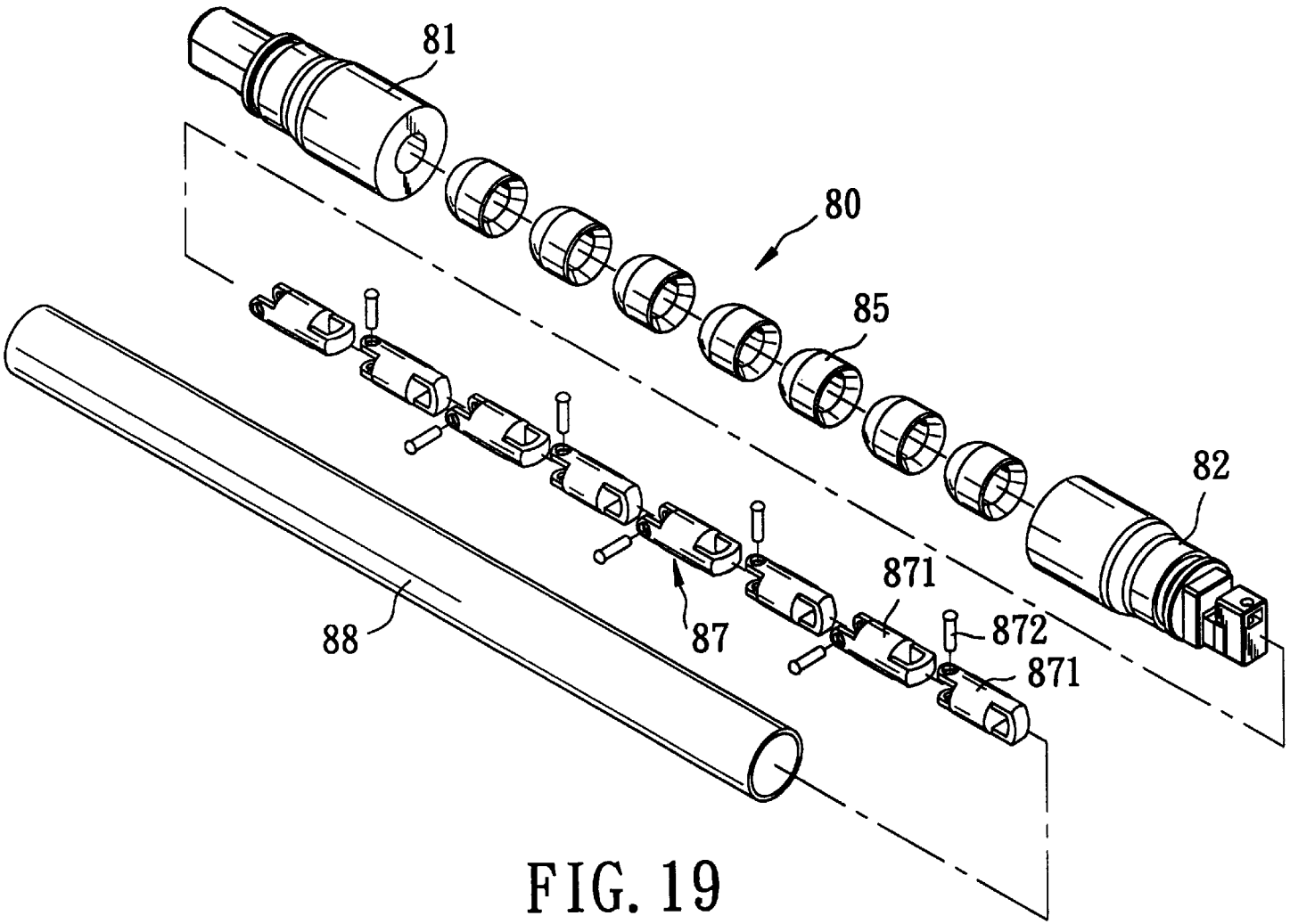
FIG. 19 is a fragmentary exploded perspective view of the shackle unit of FIG. 18, but replacing the rope with a chain member.
Figure 20:
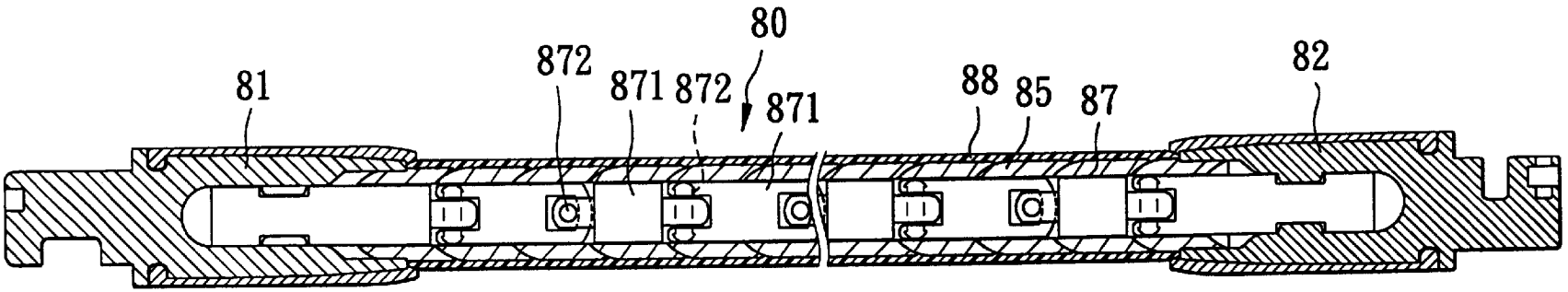
FIG. 20 is a fragmentary sectional view of the shackle unit of FIG. 19.

The shackle unit 80 further includes a plurality of metal sleeves 85 that are sleeved on the elongated shackle portion 84 between the tubular members 86. Each of the metal sleeves 85 has a generally semi-spherical inserting end 851 and a generally semi-spherical receiving hole 852 opposite to the inserting end 851 and having a shape conforming to that of the inserting end 851. The inserting end 851 of each of the metal sleeves 85 is inserted into the receiving hole 852 of an adjacent one of the metal sleeves 85 so as to permit engagement between each two adjacent ones of the metal sleeves 85 and engagement between each of the metal sleeves 85 and the elongated shackle portion 84 when the metal sleeves 85 and the elongated shackle portion 84 are compressed and are deformed and so as to protect the elongated shackle portion 84 from sabotage. Each of two outermost ones of the metal sleeves 85 are formed with three spaced apart notches 853 that respectively engage the wedging plates 8612 of a respective one of the tubular members 86 in a wedging manner. The elongated shackle portion 84 can be in the form of a rope (see FIG. 13), or of a chain 87(see FIGS. 19 and 20) with a flexible protective sleeve 88. The chain 87 includes a plurality of interconnected rods 872 and links 871.

Figure 21:
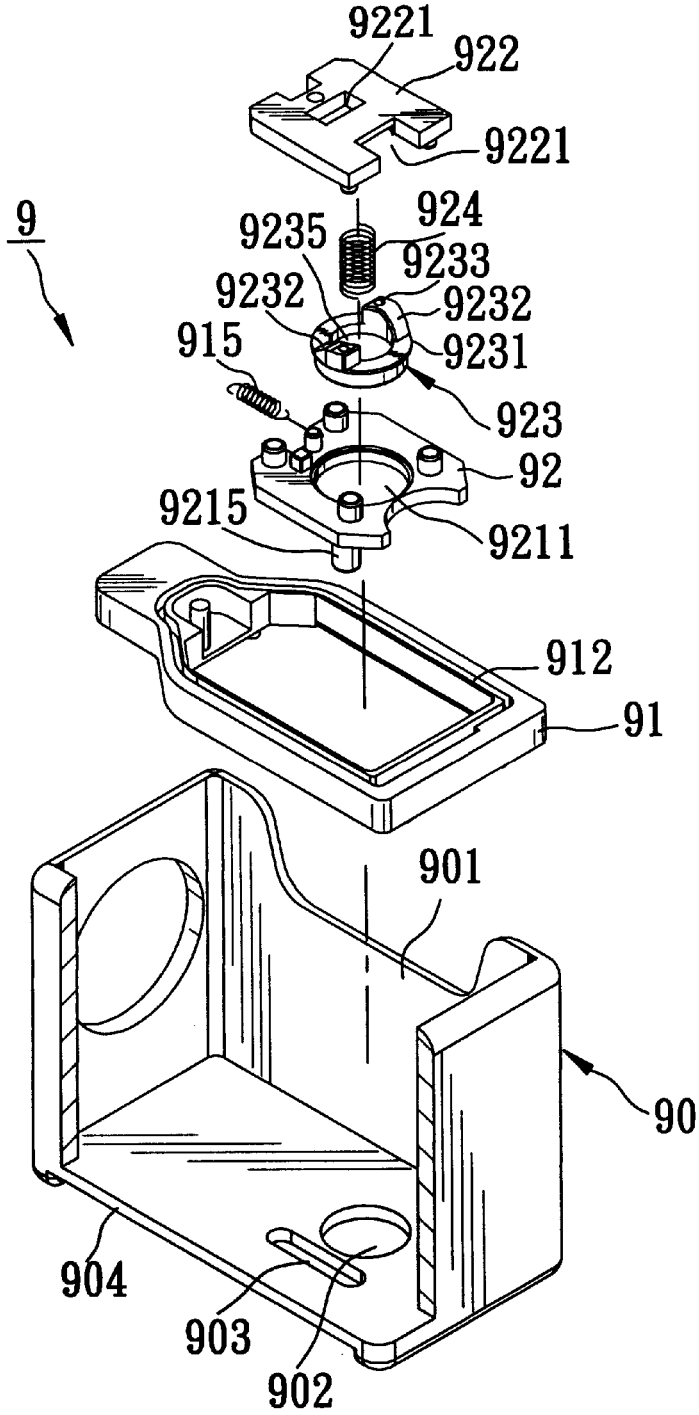
FIG. 21 is a partly exploded perspective view of a lock protective sleeve that is modified from the previous protective sleeve shown in FIG. 6.
Figure 22:
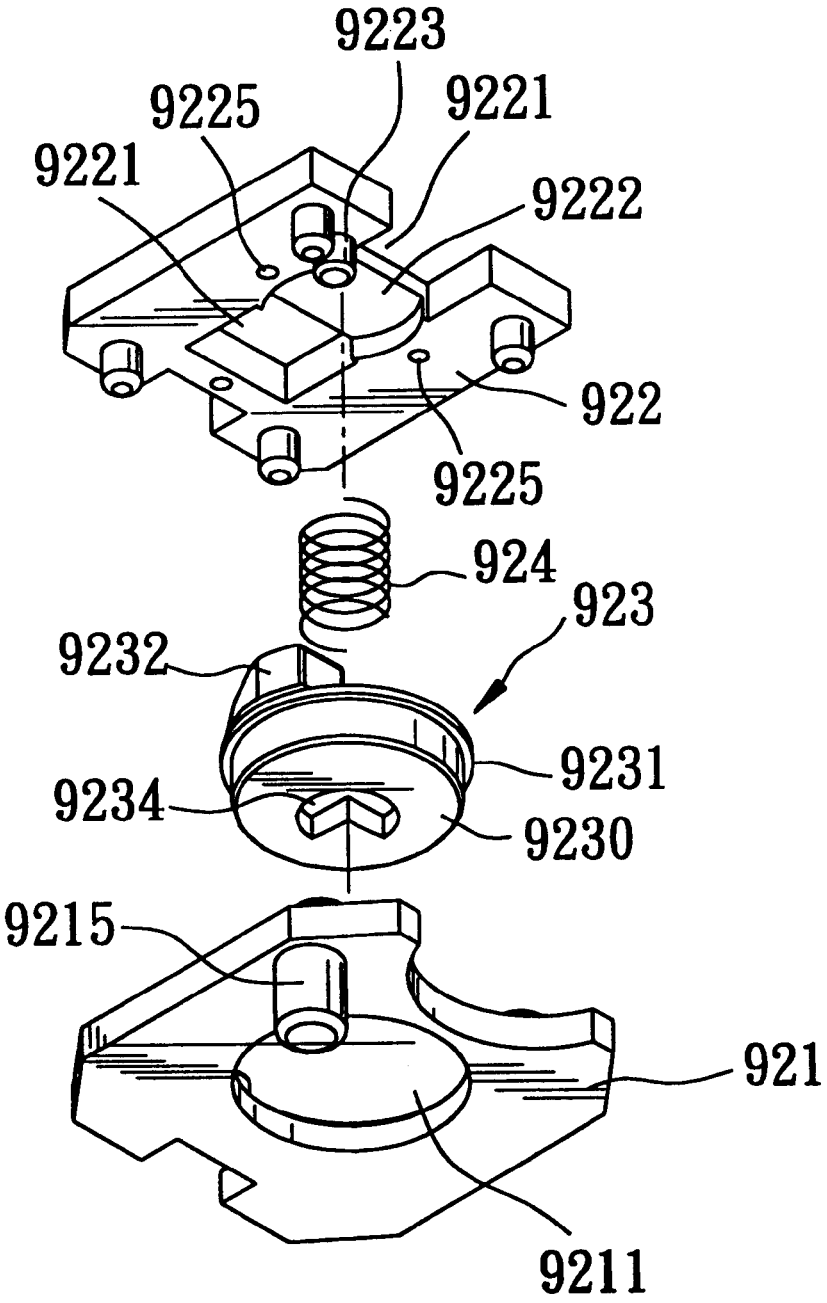
FIG. 22 is a fragmentary exploded perspective view of the lock protective sleeve of FIG. 21, which is viewed from a bottom side.
Figure 23A:
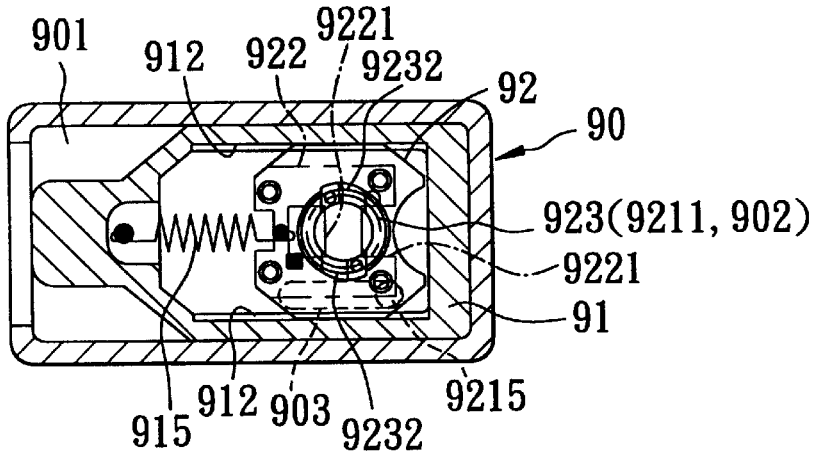
FIGS. 23A and 23B are sectional views of the lock protective sleeve of FIG. 21, illustrating how a blocking member engages a sleeve body to prevent access of the lock core.
Figure 23B:
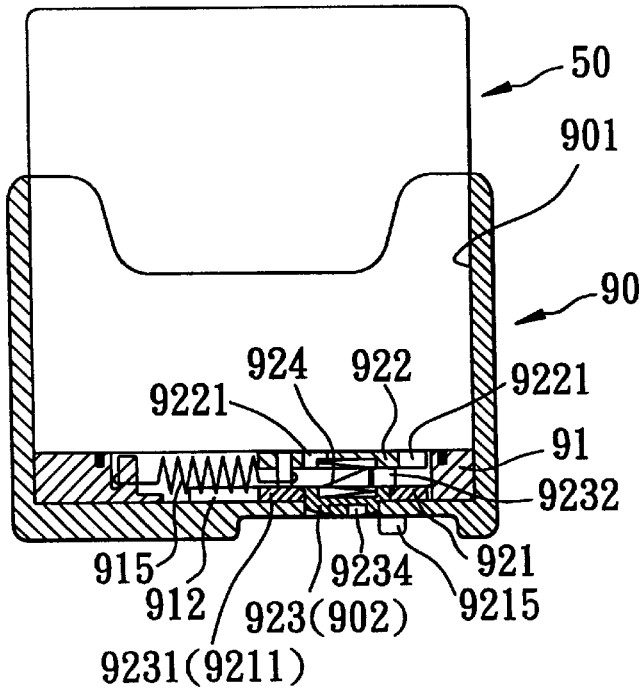
Figure 24A:
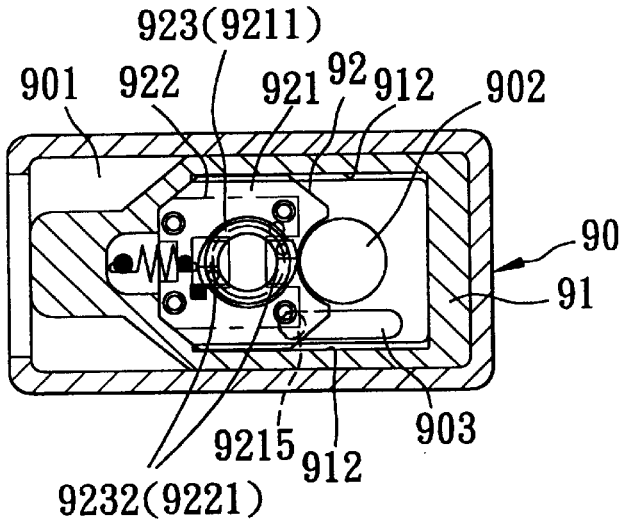
FIGS. 24A and 24B are sectional views of the lock protective sleeve of FIG. 21 that are similar to FIGS. 23A and 23B, but with the blocking member disengaging from the sleeve body to permit access of the lock core.
Figure 24B:
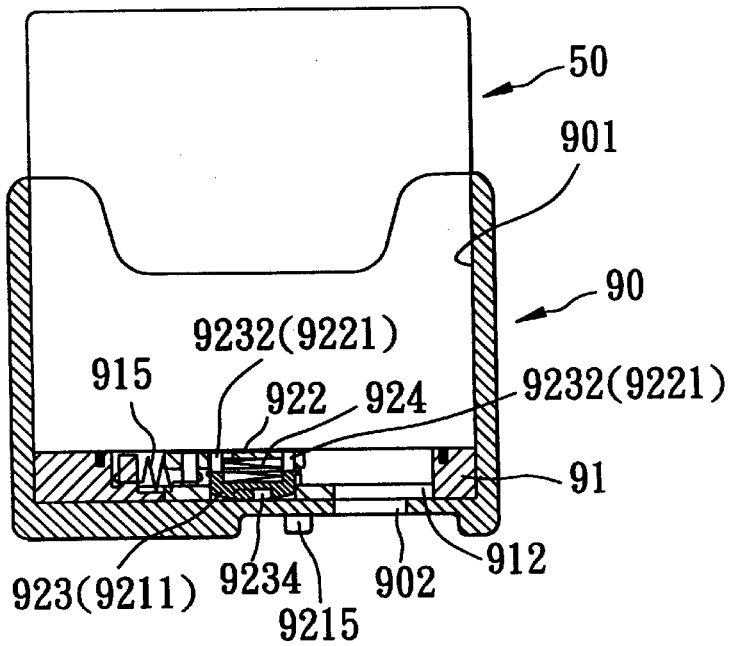

Referring to FIGS. 21 and 22, in combination with FIGS. 12 and 13, the resilient lock protective sleeve 9 includes: a hollow sleeve body 90 sleeved on the lock casing 50, the sleeve body 90 having an open end 901 that permits insertion of the lock casing 50 thereinto, and a front wall 904 that is opposite to the open end 901 and that is formed with an access opening 902 aligned with the lock core opening 502 so as to permit extension of the key therethrough, and a slot 903 adjacent to the access opening 902; a supporting frame 91 mounted in the sleeve body 90 around the access opening 902 and the slot 903, confronting the front wall 904, and formed with a guiding groove 912; a sliding member 92 mounted slidably in the supporting frame 91, formed with a central opening 9211, and slidable along the guiding groove 912 in a transverse direction relative to the lock core 60 between a first position, in which, the central opening 9211 is aligned with the access opening 902 and the lock core opening 502, and a second position, in which, the central opening 9211 is offset from the access opening 902; an urging member 915 interconnecting the sliding member 92 and the supporting frame 91 so as to urge the sliding member 92 to move from the first position to the second position; a blocking member 923 mounted movably on the sliding member 92 and having a front end 9230 that projects through the central opening 9211, the blocking member 923 being movable in an axial direction relative to the lock core 60 between a first engaging position, in which, the front end 9230 of the blocking member 923 projects into the access opening 902 and engages a periphery of the access opening 902 so as to prevent movement of the sliding member 92 and so as to close the central opening 9211 and prevent access of the lock core opening 502, and a first disengaging position, in which the front end 9230 of the blocking member 923 moves away and disengages from the periphery of the access opening 902 so as to permit co-movement of the sliding member 92 and the blocking member 923 in the transverse direction to the second position, which, in turn, permits access of the lock core opening 502 via the central opening 9211 and the access opening 902; an operating lever 9215 that projects from the sliding member 92 through the slot 903 to an exterior of the sleeve body 90 for moving the sliding member 92 in the transverse direction; and a biasing member 924 for urging the blocking member 923 to move from the first disengaging position to the first engaging position.

The lock protective sleeve 9 further includes a spring mounting plate 922 mounted on the sliding member 92 and formed with a first spring-mounting recess 9222, a pair of shallow retaining grooves 9225 disposed diametrically around the first spring-mounting recess 9222, a pair of docking slots 9221 disposed diametrically around the first spring-mounting recess 9222 and transverse to a line passing to the shallow retaining grooves 9225, and a stopper 9223 disposed adjacent to the first spring-mounting recess 9222. The blocking member 923 has a cylindrical part 9231 defining the front end 9230 and extending movably through the central opening 9211 in the sliding member 92, a second spring-mounting recess 9235 formed in the cylindrical part 9231 and aligned with the first spring-mounting recess 9222, a pair of diametrically disposed limiting protrusions 9232 projecting from the cylindrical part 9231 toward the spring mounting plate 922, a pair of circular retaining tongues 9233 respectively projecting from the limiting protrusions 9232 to releasably engage the shallow retaining grooves 9225 in the spring mounting plate 922, and a coded protrusion 9234 projecting from the cylindrical part 9231 in a direction opposite to the limiting protrusions 9232 toward the access opening 902 in the sleeve body 90. The biasing member 924 is in the form of a coil spring that is disposed between and that extends into the first and second spring-mounting recesses 9221, 9235 to abut against the cylindrical part 9231 and the spring mounting plate 922 so as to urge the blocking member 923 to move toward the access opening 902. The blocking member 923 is rotatable relative to the spring-mounting plate 922 between a second engaging position, in which, the retaining tongues 9233 respectively engage the shallow retaining grooves 9225 so as to prevent the axial movement of the blocking member 923, and a second disengaging position, in which, the retaining tongues 9233 move away from the shallow retaining grooves 9225 and the limiting protrusions 9232 are aligned with the docking slots 9221 so as to permit axial movement of the blocking member 923 against the urging action of the biasing member 924 from the first engaging position to the first disengaging position when the coded protrusion 9234 is pushed via the key. The stopper 9223 is engageable with the limiting protrusions 9232 so as to limit the blocking member 923 to rotate between the second engaging position and the second disengaging position.

Figure 25:
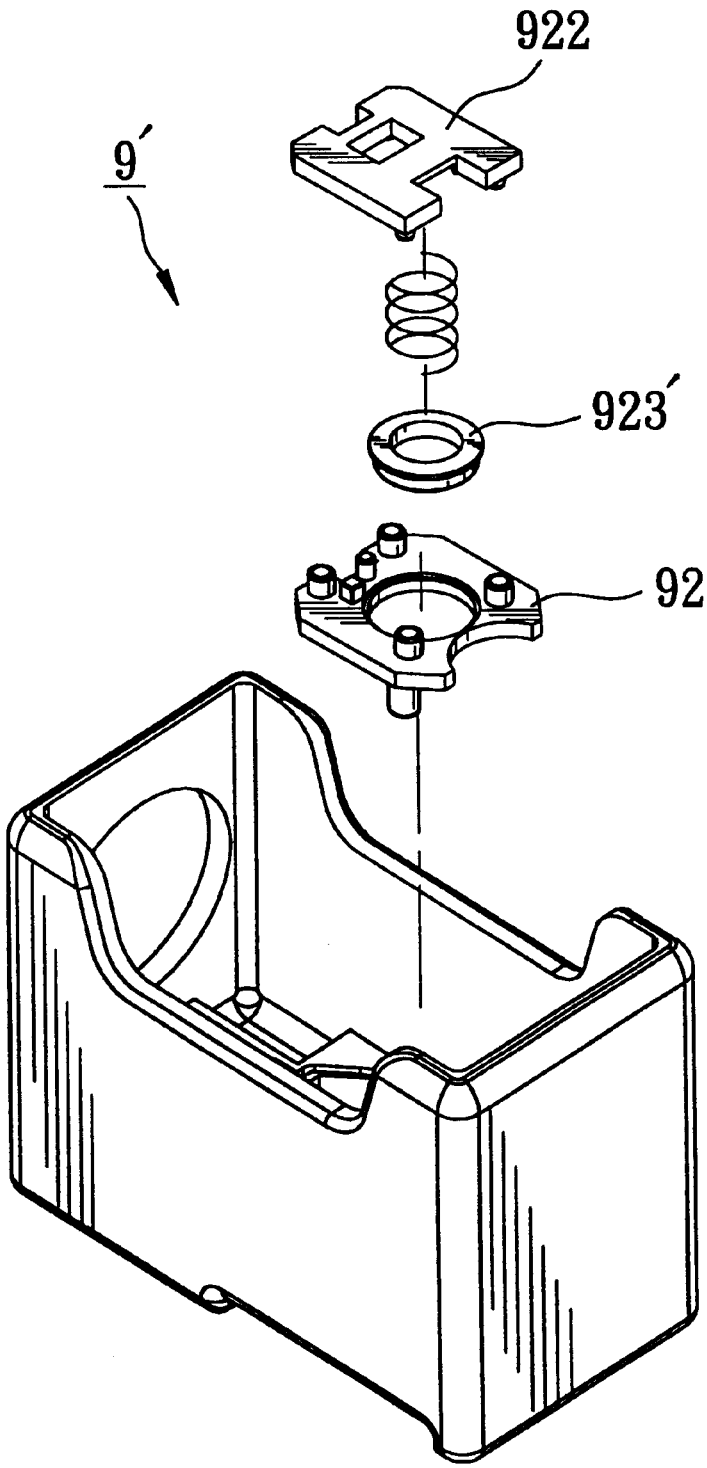
FIG. 25 is an exploded perspective view of a lock protective sleeve that is modified from the previous protective sleeve shown in FIG. 21.

FIG. 25 illustrates another lock protective sleeve 9' that is similar to the previous embodiment shown in FIG. 21, except that the blocking member 923' is in the form of an annular ring without the limiting protrusions 9232 and the coded protrusions 9234 shown in FIG. 21.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A shackle lock comprising:

a seamless lock casing having a lock core chamber, a lock core opening for access to said lock core chamber and aligned with said lock core chamber in a first direction, a first shackle chamber, a first shackle hole for access to said first shackle chamber and aligned with said first shackle chamber in a second direction parallel to the first direction, a second shackle chamber, a second shackle hole for access to said second shackle chamber and aligned with said second shackle chamber in a third direction transverse to the second direction, a first channel confined by a first channel-confining wall and extending in a fourth direction transverse to said first and second directions for communicating said lock core chamber and said first shackle chamber, and a second channel confined by a second channel-confining wall and extending in the second direction for communicating said first shackle chamber and said second shackle chamber;

a lock core received in said lock core chamber via said lock core opening and having a latch member and a keypassage that is exposed from said lock core opening and that is adapted to receive a key for moving said latch member between a locking position, in which said latch member extends through said first channel and projects into said first shackle chamber, and an unlocking position, in which said latch member is moved out of said first shackle chamber; and a shackle unit including first and second shackle connecting members and a flexible elongated shackle portion with two opposite ends connected respectively to said first and second shackle connecting members, said first shackle connecting member being extendible into said first shackle chamber via said first shackle hole and being formed with a locking groove for engaging said latch member when said latch member is moved to the locking position, said second shackle connecting member being extendible into said second shackle chamber via said second shackle hole and being provided with a retaining member that extends into said second channel and that engages said second channel-confining wall upon movement of said second shackle connecting member in said third direction so as to retain said second shackle connecting member in said lock casing, said locking groove in said first shackle connecting member being disengaged from said latch member when said latch member is moved to the unlocking position, thereby permitting removal of said first shackle connecting member from said lock casing via said first shackle hole, said retaining member on said second shackle connecting member being accessible by means of a tool which is inserted into said second channel via said first shackle chamber and said first shackle hole when said first shackle connecting member is removed from said first shackle hole and being adapted to be actuated by the tool for disengaging from said second channel-confining wall in order to be removed from said lock casing via said second shackle hole;

wherein said latch member includes a latch base which projects from said lock core in said lock core chamber in said first direction, which is rotatable when said lock core is operated via the key, and which is formed with a retaining hole extending in said first direction, said latch member further including a latch body which has an engaging end extendible into said locking groove, a linking arm projecting from said engaging end in said fourth direction to said retaining hole, and an engaging tongue projecting from said linking arm into said retaining hole so that rotation of said latch base results in movement of said latch body in said fourth direction toward and away from said locking groove, thereby permitting engagement and disengagement between said engaging end and said locking groove; and wherein said latch base has a curved stopping wall that extends curvedly from a periphery of said retaining hole, said latch body further including a stopping arm that projects from said engaging end toward said stopping wall in such a manner that said stopping arm releasably engages said stopping wall when said latch member is moved from said locking position to said unlocking position so as to prevent further rotation of said latch base and that said stopping wall moves away from said engaging arm when said latch member is moved from said unlocking position to said locking position.

2. The shackle lock as claimed in claim 1, wherein said second shackle connecting member of said shackle unit is formed with a slot that communicates with said second channel, said retaining member including a retaining block mounted slidably in said slot, and a biasing spring received in said slot for biasing said retaining block to extend out of said slot and into said second channel so as to prevent removal of said second shackle connecting member from said lock casing via said second shackle hole, said retaining block being adapted to be depressed by the tool in said second direction for retracting into said slot so as to permit removal of said second shackle connecting member from said lock casing via said second shackle hole.

3. The shackle lock as claimed in claim 1, wherein said latch member engages said first channel-confining wall upon movement of said lock core in said first direction when said latch member is positioned at said unlocking position so as to prevent removal of said lock core from said lock casing via said lock core opening, said latch member being accessible by the tool which is inserted into said first channel via said first shackle chamber and said first shackle hole when said first shackle connecting member is removed from said first shackle hole, and being adapted to be actuated by the tool for disengaging from said first channel-confining wall in order to be removed from said lock casing via said lock core opening.

4. The shackle lock as claimed in claim 3, wherein said latch member includes a latch base which projects from said lock core in said lock core chamber in said first direction, which is rotatable when said lock core is operated via the key, and which is formed with a cavity, said latch member further including a latch body mounted on said latch base and extending into said cavity, and a biasing spring received in said cavity for biasing said latch body to extend out of said cavity and to project from said latch base into said first shackle chamber when said latch member is positioned at said locking position, said latch body being adapted to be depressed in said fourth direction by the tool against biasing action of said biasing spring for retracting into said cavity to permit removal of said lock core from said lock casing.

5. The shackle lock as claimed in claim 1, wherein said first shackle connecting member of said shackle unit is formed with a stud that extends into said second channel when said first shackle connecting member extends into said first shackle chamber, said retaining member on said second shackle connecting member being formed with a recess for receiving said stud when said first and second shackle connecting members are inserted into said first and second shackle chambers, respectively.

6. The shackle lock as claimed in claim 1, wherein said first shackle connecting member has two opposite flat faces, said locking groove extending between said flat faces, said latch body further including two opposite guide wings that project from said engaging end of said latch body and that are in sliding contact with said flat faces, respectively.

7. The shackle lock as claimed in claim 1, further comprising a resilient lock protective sleeve which includes:

a sleeve body sleeved on said lock casing, said sleeve body having an open end that permits insertion of said lock casing thereinto, and two access openings aligned respectively with said first and second shackle holes in said lock casing to permit extension of said first and second shackle connecting members of said shackle unit therethrough; and a cover flap hinged to said sleeve body at said open end, said cover flap being pivotable toward said lock core opening in said lock casing for covering the same, and away from said lock core opening to permit access to said lock core via said lock core opening.

8. The shackle lock as claimed in claim 7, wherein said cover flap is formed with a plug which is inserted into said keypassage when said cover flap covers said lock core opening.

9. A shackle lock comprising:

a seamless lock casing having a lock core chamber, a lock core opening for access to said lock core chamber and aligned with said lock core chamber in a first direction, a first shackle chamber, a first shackle hole for access to said first shackle chamber and aligned with said first shackle chamber in a second direction parallel to the first direction, a second shackle chamber, a second shackle hole for access to said second shackle chamber and aligned with said second shackle chamber in a third direction transverse to the second direction, a first channel confined by a first channel-confining wall and extending in a fourth direction transverse to said first and second directions for communicating said lock core chamber and said first shackle chamber, and a second channel confined by a second channel-confining wall and extending in the second direction for communicating said first shackle chamber and said second shackle chamber;

a lock core received in said lock core chamber via said lock core opening and having a latch member and a keypassage that is exposed from said lock core opening and that is adapted to receive a key for moving said latch member between a locking position, in which said latch member extends through said first channel and projects into said first shackle chamber, and an unlocking position, in which said latch member is moved out of said first shackle chamber; and a shackle unit including first and second shackle connecting members and a flexible elongated shackle portion with two opposite ends connected respectively to said first and second shackle connecting members, said first shackle connecting member being extendible into said first shackle chamber via said first shackle hole and being formed with a locking groove for engaging said latch member when said latch member is moved to the locking position, said second shackle connecting member being extendible into said second shackle chamber via said second shackle hole and being provided with a retaining member that extends into said second channel and that engages said second channel-confining wall upon movement of said second shackle connecting member in said third direction so as to retain said second shackle connecting member in said lock casing, said locking groove in said first shackle connecting member being disengaged from said latch member when said latch member is moved to the unlocking position, thereby permitting removal of said first shackle connecting member from said lock casing via said first shackle hole, said retaining member on said second shackle connecting member being accessible by means of a tool which is inserted into said second channel via said first shackle chamber and said first shackle hole when said first shackle connecting member is removed from said first shackle hole and being adapted to be actuated by the tool for disengaging from said second channel-confining wall in order to be removed from said lock casing via said second shackle hole;

wherein said second shackle connecting member is formed with a shackle cavity and a first screw hole in communication with said shackle cavity, said retaining member including a retaining body formed with a second screw hole, said shackle lock further comprising a screw nut fixed in said shackle cavity, and a screw bolt extending through said first and second screw holes and threadedly engaging said screw nut so as to secure said retaining member to said second shackle connecting member, said screw bolt being accessible via said first shackle chamber and said first shackle hole when said first shackle connecting member is removed from said locking case, thereby permitting disengagement of said retaining member from said second shackle connecting member and removal of said second shackle connecting member from said locking case.

10. The shackle lock as claimed in claim 9, wherein said second shackle connecting member is further formed with a first notch adjacent to said shackle cavity and extending in said second direction, said retaining body being further formed with a second notch that meshes with said first notch when said retaining member is secured to said second shackle connecting member.

11. The shackle lock as claimed in claim 10, wherein said second shackle connecting member is further formed with two opposite guides extending in said second direction, said retaining body having two opposite legs extending from a periphery of said second screw hole in said second direction and formed with guiding grooves that slidably engage said guides, respectively.

12. The shackle lock as claimed in claim 11, wherein said retaining member further includes a stud that projects from said retaining body in said second direction, said first shackle connecting member being formed with a recess for receiving said stud when said first and second shackle connecting members are inserted into said first and second shackle chambers, respectively.

13. A shackle lock comprising:

a seamless lock casing having a lock core chamber, a lock core opening for access to said lock core chamber and aligned with said lock core chamber in a first direction, a first shackle chamber, a first shackle hole for access to said first shackle chamber and aligned with said first shackle chamber in a second direction parallel to the first direction, a second shackle chamber, a second shackle hole for access to said second shackle chamber and aligned with said second shackle chamber in a third direction transverse to the second direction, a first channel confined by a first channel-confining wall and extending in a fourth direction transverse to said first and second directions for communicating said lock core chamber and said first shackle chamber, and a second channel confined by a second channel-confining wall and extending in the second direction for communicating said first shackle chamber and said second shackle chamber;

a lock core received in said lock core chamber via said lock core opening and having a latch member and a keypassage that is exposed from said lock core opening and that is adapted to receive a key for moving said latch member between a locking position, in which said latch member extends through said first channel and projects into said first shackle chamber, and an unlocking position, in which said latch member is moved out of said first shackle chamber; and a shackle unit including first and second shackle connecting members and a flexible elongated shackle portion with two opposite ends connected respectively to said first and second shackle connecting members, said first shackle connecting member being extendible into said first shackle chamber via said first shackle hole and being formed with a locking groove for engaging said latch member when said latch member is moved to the locking position, said second shackle connecting member being extendible into said second shackle chamber via said second shackle hole and being provided with a retaining member that extends into said second channel and that engages said second channel-confining wall upon movement of said second shackle connecting member in said third direction so as to retain said second shackle connecting member in said lock casing, said locking groove in said first shackle connecting member being disengaged from said latch member when said latch member is moved to the unlocking position, thereby permitting removal of said first shackle connecting member from said lock casing via said first shackle hole, said retaining member on said second shackle connecting member being accessible by means of a tool which is inserted into said second channel via said first shackle chamber and said first shackle hole when said first shackle connecting member is removed from said first shackle hole and being adapted to be actuated by the tool for disengaging from said second channel-confining wall in order to be removed from said lock casing via said second shackle hole;

wherein each of said first and second shackle connecting members is formed with an insertion hole which is confined by a hole-confining wall and which receives a respective one of said opposite ends of said elongated shackle portion, said shackle unit further including two tubular members disposed in said insertion holes in said first and second shackle connecting members and sleeved on said opposite ends of said elongated shackle portion, respectively, each of said tubular member including a plurality of grooved arcuate parts which are connected in such a manner that two of adjacent ones of said arcuate parts are wedged to each other so as to form a plurality of arcuate inner and outer grooves in said tubular member and so as to permit engagement among said tubular members, said opposite ends of said elongated shackle portion, and said hole-confining walls of said first and second shackle connecting members when said tubular members, said opposite ends of said elongated shackle portion, and said hole-confining walls of said first and second shackle connecting members are compressed and are deformed, said tubular members being made from a metal alloy and having a hardness that is greater than that of said first and second shackle connecting members so as to protect said first and second shackle connecting members from sabotage.

14. The shackle lock as claimed in claim 13, wherein said shackle unit further includes a plurality of metal sleeves that are sleeved on said elongated shackle portion between said tubular members, each of said metal sleeves having a generally semi-spherical inserting end and a generally semi-spherical receiving hole opposite to said inserting end and having a shape conforming to that of said inserting end, said inserting end of each of said metal sleeves being inserted into said receiving hole of an adjacent one of said metal sleeves so as to permit engagement between each two adjacent ones of said metal sleeves and engagement between each of said metal sleeves and said elongated shackle portion when said metal sleeves and said elongated shackle portion are compressed and are deformed and so as to protect said elongated shackle portion from sabotage.

15. The shackle lock as claimed in claim 14, wherein said elongated shackle portion is in the form of a rope.

16. The shackle lock as claimed in claim 14, wherein said elongated shackle portion is in the form of a chain.

17. A shackle lock comprising:

a seamless lock casing having a lock core chamber, a lock core opening for access to said lock core chamber and aligned with said lock core chamber in a first direction, a first shackle chamber, a first shackle hole for access to said first shackle chamber and aligned with said first shackle chamber in a second direction parallel to the first direction, a second shackle chamber, a second shackle hole for access to said second shackle chamber and aligned with said second shackle chamber in a third direction transverse to the second direction, a first channel confined by a first channel-confining wall and extending in a fourth direction transverse to said first and second directions for communicating said lock core chamber and said first shackle chamber, and a second channel confined by a second channel-confining wall and extending in the second direction for communicating said first shackle chamber and said second shackle chamber;

a lock core received in said lock core chamber via said lock core opening and having a latch member and a keypassage that is exposed from said lock core opening and that is adapted to receive a key for moving said latch member between a locking position, in which said latch member extends through said first channel and projects into said first shackle chamber, and an unlocking position, in which said latch member is moved out of said first shackle chamber; and a shackle unit including first and second shackle connecting members and a flexible elongated shackle portion with two opposite ends connected respectively to said first and second shackle connecting members, said first shackle connecting member being extendible into said first shackle chamber via said first shackle hole and being formed with a locking groove for engaging said latch member when said latch member is moved to the locking position, said second shackle connecting member being extendible into said second shackle chamber via said second shackle hole and being provided with a retaining member that extends into said second channel and that engages said second channel-confining wall upon movement of said second shackle connecting member in said third direction so as to retain said second shackle connecting member in said lock casing, said locking groove in said first shackle connecting member being disengaged from said latch member when said latch member is moved to the unlocking position, thereby permitting removal of said first shackle connecting member from said lock casing via said first shackle hole, said retaining member on said second shackle connecting member being accessible by means of a tool which is inserted into said second channel via said first shackle chamber and said first shackle hole when said first shackle connecting member is removed from said first shackle hole and being adapted to be actuated by the tool for disengaging from said second channel-confining wall in order to be removed from said lock casing via said second shackle hole; and a shackle lock comprising a resilient lock protective sleeve which includes:

a hollow sleeve body sleeved on said lock casing, said sleeve body having an open end that permits insertion of said lock casing thereinto, and a front wall that is opposite to said open end and that is formed with an access opening aligned with said lock core opening so as to permit extension of the key therethrough, and a slot adjacent to said access opening;

a supporting frame mounted in said sleeve body around said access opening and said slot and confronting said front wall;

a sliding member mounted slidably in said supporting frame, formed with a central opening, and slidable in a transverse direction relative to said lock core between a first position, in which, said central opening is aligned with said access opening and said lock core opening, and a second portion, in which, said central opening is offset from said access opening;

an urging member interconnecting said sliding member and said supporting frame so as to urge said sliding member to move from said first position to said second position;

a blocking member mounted movably on said sliding member and having a front end that projects through said central opening, said blocking member being movable in an axial direction relative to said lock core between a first engaging position, in which, said front end of said blocking member projects into said access opening and engages a periphery of said access opening so as to prevent movement of said sliding member and so as to close said central opening and prevent access of said lock core opening, and a first disengaging position, in which said front end of said blocking member moves away and disengages from said periphery of said access opening so as to permit co-movement of said sliding member and said blocking member in said transverse direction to said second position, which, in turn, permits access of said lock core opening via said central opening and said access opening;

an operating lever that projects from said sliding member through said slot to an exterior of said sleeve body for moving said sliding member in said transverse direction; and a biasing member for urging said blocking member to move from said first disengaging position to said first engaging position.

18. The shackle lock as claimed in claim 17, wherein said lock protective sleeve further includes a spring mounting plate mounted on said sliding member and formed with a first spring-mounting recess, a pair of shallow retaining grooves disposed diametrically around said first spring-mounting recess, a pair of docking slots disposed diametrically around said first spring-mounting recess and transverse to a line passing through said shallow retaining grooves, and a stopper disposed diametrically around said first spring-mounting recess, said blocking member having a cylindrical part defining said front end and extending movably through said central opening in said sliding member, a second spring-mounting recess formed in said cylindrical part and aligned with said first spring-mounting recess, a pair of diametrically disposed limiting protrusions projecting from said cylindrical part toward said spring mounting plate, a pair of circular retaining tongues respectively projecting from said limiting protrusions to releasably engage said shallow retaining grooves in said spring mounting plate, and a coded protrusion projecting from said cylindrical part in a direction opposite to said limiting protrusions toward said access opening in said sleeve body, said biasing member being in the form of a coil spring that is disposed between and that extends into said first and second spring-mounting recesses to abut against said cylindrical part and said spring mounting plate, said blocking member being rotatable relative to said spring-mounting plate between a second engaging position, in which, said retaining tongues respectively engage said shallow retaining grooves so as to prevent said axial movement of said blocking member, and a second disengaging position, in which, said retaining tongues move away from said shallow retaining grooves and said limiting protrusions are aligned with said docking slots so as to permit axial movement of said blocking member from said first engaging position to said first disengaging position when said coded protrusion is pushed via the key, said stoppers being engageable with said limiting protrusions so as to limit said blocking member to rotate between said second engaging position and said second disengaging position.

* * * * *